US006817704B2

(12) United States Patent
Eguchi et al.

(10) Patent No.: US 6,817,704 B2
(45) Date of Patent: Nov. 16, 2004

(54) LIQUID EJECTING DEVICE AND LIQUID EJECTING METHOD

(75) Inventors: Takeo Eguchi, Kanagawa (JP); Iwao Ushinohama, Kanagawa (JP); Kazuyasu Takenaka, Kanagawa (JP); Yuichiro Ikemoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/354,591

(22) Filed: Jan. 29, 2003

(65) Prior Publication Data

US 2004/0036723 A1 Feb. 26, 2004

(30) Foreign Application Priority Data

Aug. 20, 2002 (JP) ..... 2002-239797
Nov. 5, 2002 (JP) ..... 2002-320862
Nov. 18, 2002 (JP) ..... 2002-334220

(51) Int. Cl.[7] ..... B41J 2/05; B41J 29/38
(52) U.S. Cl. ..... 347/60; 347/9; 347/11; 347/14
(58) Field of Search ..... 347/5, 9, 11, 14, 347/54, 56, 60–62, 65

(56) References Cited

U.S. PATENT DOCUMENTS 4,560,998 A * 12/1985 Wimmer ..... 347/9
4,808,845 A * 2/1989 Suzuki et al. ..... 326/84
5,172,142 A * 12/1992 Watanabe et al. ..... 347/14
6,068,360 A * 5/2000 Hiwada ..... 347/14
6,582,065 B1 * 6/2003 Okazaki et al. ..... 347/65

* cited by examiner

*Primary Examiner*—Stephen D. Meier
*Assistant Examiner*—An H. Do
(74) *Attorney, Agent, or Firm*—Robert J. Depke; Holland & Knight LLP

(57) ABSTRACT

In a liquid ejecting device having a head formed by a liquid ejecting portion or liquid ejecting portions arranged in parallel, the direction of ejected liquid is controlled for each liquid ejecting portion. In the head of the liquid ejecting device, heating resistors which are connected in series to one other in a liquid cell are arranged in parallel in a predetermined direction. The liquid ejecting device includes a main operation controller which performs control for ejecting liquid by supplying equal amounts of currents to the connected heating resistors, and a sub operation controller including a current-mirror circuit connected to a junction of heating resistors and its switching element. By using the current-mirror circuit and the switching element to allow a current to flow into or from a junction of the heating resistors, the amounts of currents supplied to the heating resistors are controlled and the direction of ejected liquid is controlled (changed).

31 Claims, 23 Drawing Sheets

| | | | | | | | | | | | | | | | | |
|---|---|---|---|---|---|---|---|---|---|---|---|---|---|---|---|---|
| Dp | 0 | 0 | 0 | 0 | 0 | 0 | 0 | 0 | +1 | +1 | +1 | +1 | +1 | +1 | +1 | +1 |
| 4D3 | 0 | 0 | 0 | 0 | 4 | 4 | 4 | 4 | 0 | 0 | 0 | 0 | 4 | 4 | 4 | 4 |
| 2D2 | 0 | 0 | 2 | 2 | 0 | 0 | 2 | 2 | 0 | 0 | 2 | 2 | 0 | 0 | 2 | 2 |
| D1 | 0 | 1 | 0 | 1 | 0 | 1 | 0 | 1 | 0 | 1 | 0 | 1 | 0 | 1 | 0 | 1 |
| OUTPUT | 0 | -1 | -2 | -3 | -4 | -5 | -6 | -7 | 0 | +1 | +2 | +3 | +4 | +5 | +6 | +7 |

IM (EXPRESSION 9) INDICATED BY ●

(×Id)

| | | | | | | | | |
|---|---|---|---|---|---|---|---|---|
| 4J3 | -4 | -4 | -4 | -4 | +4 | +4 | +4 | +4 |
| 2J2 | -2 | -2 | +2 | +2 | -2 | -2 | +2 | +2 |
| J1 | -1 | +1 | -1 | +1 | -1 | +1 | -1 | +1 |
| OUTPUT | -7 | -5 | -3 | -1 | +1 | +3 | +5 | +7 |

IM (EXPRESSION 8) INDICATED BY ●

(×Id)

PRIOR ART

LIQUID EJECTING DEVICE AND LIQUID EJECTING METHOD

This application claims priority to Japanese Patent Application Number JP2002-239797 filed Aug. 20, 2002, Japanese Patent Application Number JP2002-320862 filed Nov. 5, 2002, and Japanese Patent Application Number JP2002-334220 filed Nov. 18, 2002, all of which are incorporated herein by reference.

BACKGROUND OF THE INVENTION

1. Field of the Invention

The present invention relates to a technology in which, in a liquid ejecting device having a head including at least one liquid ejecting portion and in a liquid ejecting method using a head including at least one liquid ejecting portion, a current-mirror circuit is used to deflect liquid ejected from each liquid ejecting portion, and to a technology for simplifying (downsizing) entire circuit structure.

2. Description of the Related Art

Inkjet printers have been conventionally known as a type of liquid ejecting device having heads which each include a plurality of liquid ejecting portions arranged in parallel. A thermal method that uses thermal energy to eject ink is known as one of ink ejecting methods for inkjet printers.

In an example of a head structure using the thermal method, ink in an ink cell is heated by a heating element (heating resistor) disposed in the ink cell to produce bubbles in the ink on the heating element, and the energy of the generation of the bubbles ejects the ink. A nozzle is formed in the upper side of the ink cell. When the bubbles are produced in the ink in the ink cell, the ink is ejected from the ejecting outlet of the nozzle.

From the viewpoint of head structure, there are two methods, a serial method and a line method. In the serial method, an image is printed by moving a head in the width direction of printing paper. In the line method, many heads are arranged in the width direction of printing paper to form a line head for the width of the printing paper.

FIG. 21 is a plan view showing a line head 10 of the related art. Although FIG. 21 shows four heads 1 (N−1, N, N+1, and N+2), a larger number of heads 11 are actually arranged in parallel.

In each head 1, a plurality of (normally, approximately hundred units of) ink cells, heating elements, and nozzles 1*a* as described above are arranged in parallel. The line head 10 is formed by arranging the heads 1 in a predetermined direction (the width direction of printing paper).

Two adjacent heads 1 in the predetermined direction are disposed on one side and the other side across an ink-flow pass 2 extending in the predetermined direction, and the head 1 on the one side and the head 1 on the other side are alternately disposed so that both opposes each other, that is, nozzles 1*a* can oppose each other. Between the adjacent heads 1, the pitch of the nozzles 1*a* is consecutively maintained, as shown in the detail of portion A in FIG. 21 (see Japanese Unexamined Patent Application Publication No. 2002-36522).

The related art shown in FIG. 18 has the following problems.

When ink is ejected from the printer-head chips 1, it is ideal that the ink is ejected perpendicularly to the ejection surface of the printer-head chips 1. However, various factors may cause a case in which an angle at which the ink is ejected is not perpendicular.

For example, when a nozzle sheet having the nozzles 1*a* formed thereon is bonded to a head chip including the ink cells and the heating elements, the problem is positional shifting of the nozzle sheet. When the nozzle sheet is bonded so that the center of the nozzles 1*a* is positioned in the center of the ink cells and the heating elements, the ink is ejected perpendicularly to the ink ejection surface (the nozzle sheet surface). However, if positional shifting occurs between the central axis of the ink cells and the heating elements and the central axis of the nozzle 1*a*, the ink cannot be ejected perpendicularly to the ejection surface. In addition, positional shifting can be caused by a difference in coefficient of thermal expansion between the nozzle sheet, and the ink cells and the heating elements.

When such a difference in angel of ejection of ink occurs, it appears as a shift in pitch of delivered ink in the case of the serial method. In the case of the line method, the difference appears as a positional shift between two heads 1, in addition to the shift in pitch of delivered ink.

FIGS. 22A and 22B are a sectional view and plan view showing printing by the line head 10 shown in FIG. 21. In FIGS. 22A and 22B, assuming that printing paper P is fixed, the line head 10 does not move in the width direction of the printing paper P, and performs printing while moving from top to bottom of the plan view (FIG. 22B).

In the section view in FIG. 19A, among the line head 10, three heads 1, that is, the N-th head 1, the (N+1)-th head 1, and the (N+2)-th head 1 are shown.

As shown in the section view in FIG. 22A, in the N-th head 1, ink is slantingly ejected in the left direction as is indicated by the left arrow. In the (N+1)-th head 1, ink is slantingly ejected in the right direction as is indicated by the central arrow. In the (N+2)-th head 1, ink is perpendicularly ejected without a shift in angle of ejection as is indicated by the right arrow.

Accordingly, in the N-th head 1, the ink is delivered, being off to the left from a reference position, and in the (N+1)-th head 1, the ink is delivered, being off to the right from the reference position. Thus, between both, the ink in the N-th head 1 and the ink in the (N+1)-th head 1 are delivered to opposite directions. As a result, a region in which no ink is delivered is formed between the N-th head 1 and the (N+1)-th head 1. In addition, the line head 10 is only moved in the direction of the arrow in the plan view in FIG. 19B without being moved in the width direction of the printing paper P. This forms a white stripe B between the N-th head 1 and the (N+1) head 1, thus causing a problem of deterioration in printing quality.

Similarly to the above case, in the (N+1)-th head 1, the ink is delivered, being off to the right from the reference position. Thus, the (N+1)-th head 1 and the (N+2)-th head 1 have a common region in which the ink is delivered. This causes a discontinuous image and a stripe C which has a color thicker than the original color, thus causing a problem of deterioration in printing quality.

When such a shift in a position to which ink is delivered occurs, the degree to which a stripe looks noticeable depends on an image to be printed. For example, since a document or the like has many blank portions, a stripe will not look noticeable if it is formed. Conversely, in the case of printing a photograph image in almost all the portions of printing paper, if a slight strip is formed, it will look noticeable.

SUMMARY OF THE INVENTION

It is an object of the present invention to provide a liquid ejecting device having a head including a liquid ejecting portion or liquid ejecting portions arranged in parallel and a liquid ejecting method using a head including a liquid ejecting portion or liquid ejecting portions arranged in parallel, wherein the direction of liquid ejected from each liquid ejecting portion is controlled.

The present invention provides a circuit form that is particularly suitable for the case of incorporating means of deflecting ejected liquid with a head in technology in Japanese Patent Application Nos. 2002-112947 and 2002-161928 which have already been filed by the Assignee of the present Application. Also, in the present invention, by simplifying (downsizing) the entire circuit, the means can be used even for a head having a resolution of 600 dpi or higher.

According to a first aspect of the present invention, a liquid ejecting device having a head including a liquid ejecting portion or a plurality of liquid ejecting portions arranged in parallel in a predetermined direction is provided. The liquid ejecting portion or each of the liquid ejecting portions includes a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction. The liquid ejecting device includes a main operation controller which, by supplying equal amounts of currents to the connected energy generating elements in the liquid cell, performs control so that the liquid is ejected from the nozzle, and a sub operation controller provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from the nozzle is controlled.

According to a second aspect of the present invention, a liquid ejecting device having a head including a liquid ejecting portion or a plurality of liquid ejecting portions arranged in parallel in a predetermined direction is provided. The liquid ejecting portion or each of the liquid ejecting portions includes a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction. The liquid ejecting device includes a main operation controller which, by supplying equal amounts of currents to the connected energy generating elements in the liquid cell, performs control so that the liquid is ejected from the nozzle, and a sub operation controller provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from the nozzle is controlled to change with respect to a direction in which liquid is ejected by the main operation controller.

According to a third aspect of the present invention, a liquid ejecting device having a line head formed by a plurality of heads arranged in a predetermined direction is provided. The heads each are formed by a plurality of liquid ejecting portions arranged in parallel in the predetermined direction. The liquid ejecting portions each includes a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction. The liquid ejecting device includes a main operation controller which, by supplying equal amounts of currents to the connected energy generating elements in the liquid cell, performs control so that the liquid is ejected from the nozzle, and a sub operation controller provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from the nozzle is controlled.

According to a fourth aspect of the present invention, a liquid ejecting device having a line head formed by a plurality of heads arranged in a predetermined direction is provided. The heads each are formed by a plurality of liquid ejecting portions arranged in parallel in the predetermined direction. The liquid ejecting portions each include a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction. The liquid ejecting device includes a main operation controller which, by supplying equal amounts of currents to the connected energy generating elements in the liquid cell, performs control so that the liquid is ejected from the nozzle, and a sub operation controller provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from the nozzle is controlled to change to the predetermined direction with respect to a direction in which liquid is ejected by the main operation controller.

According to the present invention, by incorporating a main operation controller and a sub operation controller including a current-mirror circuit, for example, in a digital circuit, the formed integrated-circuit structure which is suitable for a head is obtained.

According to a fifth aspect of the present invention, a liquid ejecting method using a head including a liquid ejecting portion or a plurality of liquid ejecting portions arranged in parallel in a predetermined direction is provided. The liquid ejecting portion or each of the liquid ejecting portions includes a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction, and at least one current-mirror circuit is connected to a junction of the energy generating elements, and the liquid from the nozzle is controlled so as to be ejected in at least two different directions by using a main operation-control step which, by supplying equal amounts of currents to the connected energy generating elements in the liquid cell without using the at least-one current-mirror circuit, performs control so that the liquid is ejected from the nozzle, and a sub operation-control step in which, by using the current-mirror circuit to allow a current to flow into or to flow from the junction of the energy generating elements, the amount of a current supplied to each of the energy generating elements is controlled and the direction of the liquid ejected from the nozzle is controlled.

According to a sixth aspect of the present invention, a liquid ejecting method using a line head formed by a plurality of heads arranged in a predetermined direction is provided. The heads each are formed by a plurality of liquid ejecting portions arranged in parallel in the predetermined direction. The liquid ejecting portions each include a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction, and at least one current-mirror circuit is connected to a junction of the energy generating elements. The liquid from the nozzle is controlled so as to be ejected in at least two different directions by using a main operation-control step in which, by supplying equal amounts of currents to the connected energy generating elements in the liquid cell without using the at least one current-mirror circuit, the liquid is controlled to be ejected from the nozzle, and a sub operation-control step in which, by using the current-mirror circuit to allow a current to flow into or to flow from the junction of the energy generating elements, the amount of a current supplied to each of the energy generating elements is controlled and the direction of the liquid ejected from the nozzle is controlled.

According to a seventh aspect of the present invention, a liquid ejecting device having a head including a liquid ejecting portion or a plurality of liquid ejecting portions arranged in parallel in a predetermined direction is provided. The liquid ejecting portion or each of the liquid ejecting portions includes a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction, and the liquid ejecting device includes a control unit provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from the nozzle is controlled.

According to an eighth aspect of the present invention, a liquid ejecting device having a head including a liquid ejecting portion or a plurality of liquid ejecting portions arranged in parallel in a predetermined direction is provided. The liquid ejecting portion or each of the liquid ejecting portions includes a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction, and the liquid ejecting device includes an ejection deflecting unit provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the liquid ejected from the nozzle is deflected in the predetermined direction and the opposite direction thereto.

According to the present invention, by controlling the amounts of currents flowing in energy generating elements to differ, a difference is set in the time required for generating bubbles by the energy generating elements. Based on the difference, the direction of ejected liquid is controlled and is also changed. By deflecting ejected liquid, a position to which the liquid is delivered can be changed.

According to a ninth aspect of the present invention, a ninth aspect of the present invention, a liquid ejecting device having a line head formed by a plurality of heads arranged in a predetermined direction is provided. The heads each are formed by a plurality of liquid ejecting portions arranged in parallel in the predetermined direction. The liquid ejecting portions each include a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction, and the liquid ejecting device includes a control unit provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from the nozzle is controlled.

According to a tenth aspect of the present invention, a liquid ejecting device having a line head formed by a plurality of heads arranged in a predetermined direction is provided. The heads each are formed by a plurality of liquid ejecting portions arranged in parallel in the predetermined direction. The liquid ejecting portions each include a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction, and the liquid ejecting device includes an ejection deflecting unit provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the liquid ejected from the nozzle is deflected in the predetermined direction and the opposite direction thereto.

According to an eleventh aspect of the present invention, a liquid ejecting device using a head including a liquid ejecting portion or a plurality of liquid ejecting portions arranged in parallel in a predetermined direction is provided. The liquid ejecting portion or each of the liquid ejecting portions includes a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction, and at least one current-mirror circuit is connected to a junction of the energy generating elements, and by using the at least one current-mirror circuit to allow a current to flow into or to flow from the junction of the energy generating elements, the amount of a current supplied to each of the energy generating elements is controlled and the direction of the liquid ejected from the nozzle is controlled.

According to a twelfth aspect of the present invention, a liquid ejecting method using a line head formed by a plurality of heads arranged in a predetermined direction is provided. The heads each are formed by a plurality of liquid ejecting portions arranged in parallel in the predetermined direction. The liquid ejecting portions each include a liquid cell for containing liquid, at least one energy generating element provided in the liquid cell which produces a bubble in response to the supply of energy, and a nozzle for ejecting the liquid in the liquid cell by using the bubble produced by the at least one energy generating element. In the liquid cell, the energy generating elements are connected in series to one another and are arranged in parallel in the predetermined direction, and at least one current-mirror circuit is connected to a junction of the energy generating elements, and by using the at least one current-mirror circuit to allow a current to flow into or to flow from the junction of the energy generating elements, the amount of a current supplied to each of the energy generating elements is controlled and the direction of the liquid ejected from the nozzle is controlled.

According to a thirteenth aspect of the present invention, a liquid ejecting device having a head including a plurality of liquid ejecting portions arranged in parallel in a predetermined direction is provided. The liquid ejecting portions each include a liquid cell for containing liquid, at least one energy generating element provided in the liquid cell which produces a bubble in response to the supply of energy, a nozzle for ejecting the liquid in the liquid cell by using the bubble produced by the at least one energy generating element. In the liquid cell, the heating elements are connected in series to one another and are arranged in parallel in the predetermined direction. The liquid ejecting device includes a main operation controller which, by supplying equal amounts of currents to all the heating elements, performs control so that the liquid is ejected from the nozzle, and a sub operation controller which supplies currents to all the heating elements in the liquid cell, and which, by setting a difference between the amount of the current flowing in at least one of the heating elements and the amount of the current flowing in another one of the heating elements, performs control based on the difference so that the ejected liquid is deflected in the predetermined direction with respect to a direction in which liquid is ejected by the main operation controller. The liquid ejecting portions arranged in parallel are divided into a plurality of blocks so that groups of the liquid ejecting portions respectively belong to the blocks, and the liquid ejecting device includes a dedicated circuit provided for each of the liquid ejecting portions, and a common circuit provided for each of the blocks which is shared by the liquid ejecting portions belonging to the block, and which includes at least part of one of the main operation controller and the sub operation controller and ejects liquid from one of the liquid ejecting portions belonging to the block.

According to the present invention, when liquid is ejected, one liquid ejecting portion can be prevented from affecting another liquid ejecting portion. In the case of such control, at least part of a circuit for ejecting liquid may be provided a single common circuit for a plurality of liquid ejecting portions. This enables circuit simplification for the entire head.

According to the present invention, by using a plurality of energy generating elements and a current-mirror circuit to allow a current to flow into or from a junction of the energy generating elements so that the amounts of currents flowing in the energy generating elements differ, a difference can be set in bubble producing time between energy generating elements. Accordingly, based on the difference, the direction of ejected liquid can be controlled. More specifically, it can be changed (shifted from perpendicularity with respect to a plane of ejection). By deflecting ejected liquid, a position to which the liquid is delivered can be changed.

Therefore, for example, if there is a shift in a position to which liquid ejected from a particular liquid ejecting portion is delivered, the shift can be corrected.

Moreover, according to the present invention, in the case of incorporating means of changing ejected liquid with a head, simplification (downsizing) of the entire circuit enables the means to be used even for a high resolution head.

DESCRIPTION OF THE PREFERRED EMBODIMENTS

Embodiments of the present invention are described below with reference to the accompanying drawings.

First Embodiment

Figure 1:
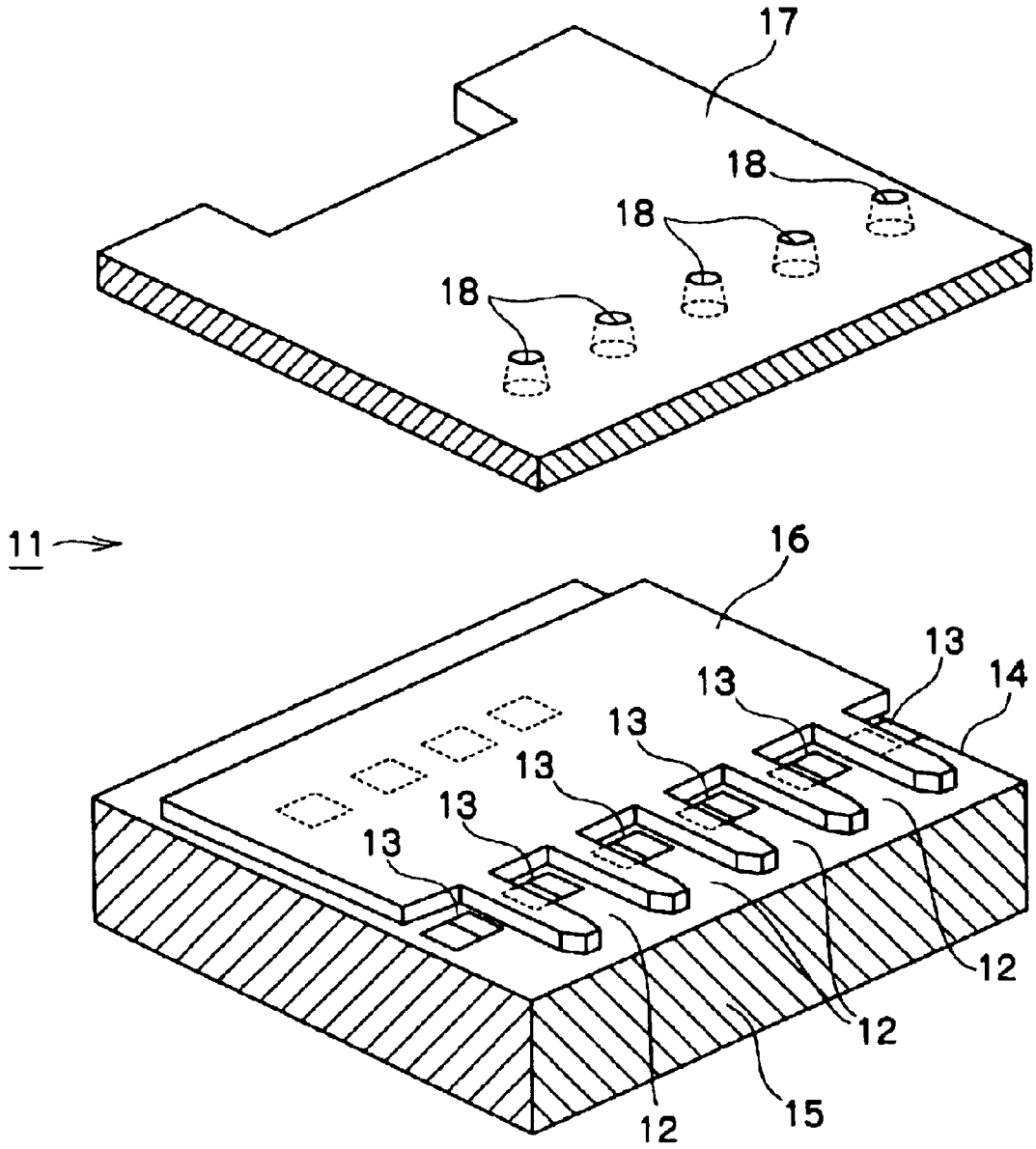
FIG. 1 is an exploded perspective view showing a head to which a liquid ejecting device of the present invention is applied.

FIG. 1 is an exploded perspective view showing one of heads 11 in an inkjet printer (hereinafter referred to as a "printer") in which a liquid ejecting device of the present invention is used. In FIG. 1, a nozzle sheet 17 is bonded to a barrier layer 16. The nozzle sheet 17 is shown, with it separated.

In the head 11, a base member 14 includes a semiconductor substrate composed of silicon, etc., and heating resistors 13 (corresponding to energy generating elements in the present invention) formed on one surface of the semiconductor substrate 15. The heating resistors 13 are electrically connected to an external circuit by a conductor portion (not shown) formed on the semiconductor substrate 15.

The barrier layer 16 is made of a photosensitive cyclized rubber resist or an exposure-curing dry-film resist, and is formed by stacking the resist on the entirety of the surface of the semiconductor substrate 15 on which the heating resistors 13 are formed, and using a photolithography process to remove unnecessary portions.

The nozzle sheet 17 has a plurality of nozzles 18 therein, and is formed by, for example, electroforming technology using nickel. The nozzle sheet 17 is bonded onto the barrier layer 16 so that the positions of the nozzles 18 can correspond to the positions of the heating resistors 13, that is, the nozzles 18 can oppose the heating resistors 13.

Ink cells 12 (corresponding to liquid cells in the present invention) are constituted so as to surround the heating resistors 13 by the substrate member 14, the barrier layer 16, and the nozzle sheet 17. Specifically, the substrate member 14 forms the bottom walls of the ink cells 12, the barrier layer 16 forms the side walls of the ink cells 12, and the nozzle sheet 17 forms the top walls of the ink cells 12. In this structure, the ink cells 12 have regions are connected to ink-flow paths (not shown).

The above head 11 normally includes the heating resistors 13 in units of hundreds, and the ink cells 12 provided with the heating resistors 13. In response to a command from the control unit of the printer, each heating resistor 13 is uniquely selected, and the ink of the ink cell 12 corresponding to the heating resistor 13 can be ejected from the nozzle 18 opposing the ink cell 12.

In other words, the ink cell 12 is filled with ink supplied from an ink tank (not shown) joined to the head 11. By allowing a pulse current to flow through the heating resistor 13 in a short time, for example, 1 to 3 microseconds, the heating resistor 13 is rapidly heated. As a result, gas-phase ink bubbles are produced in portions in contact with the heating resistor 13, and the expansion of the ink bubbles dislodges ink of some volume (the ink boils). In this manner, ink of a volume equal to that of the dislodged ink in the portion touching the nozzle 18 is ejected as ink droplets from the nozzle 18, and is delivered onto the printing paper.

In this Specification, a portion constituted by one ink cell 12, the heating resistors 13 disposed in the ink cell 12, and the nozzle 18 disposed thereabove is referred to as an "ink ejecting portion (liquid ejecting portion)". It may be said that the head 11 is formed by a plurality of ink ejecting portions.

Part (in which the ink cells 12 and the heating resistors 13 are formed on the semiconductor substrate 15) of the head 11 excluding the nozzle sheet 17 is referred to as a "head chip". In other words, a head chip to which the nozzle sheet 17 is bonded is the head 11.

Figure 21:
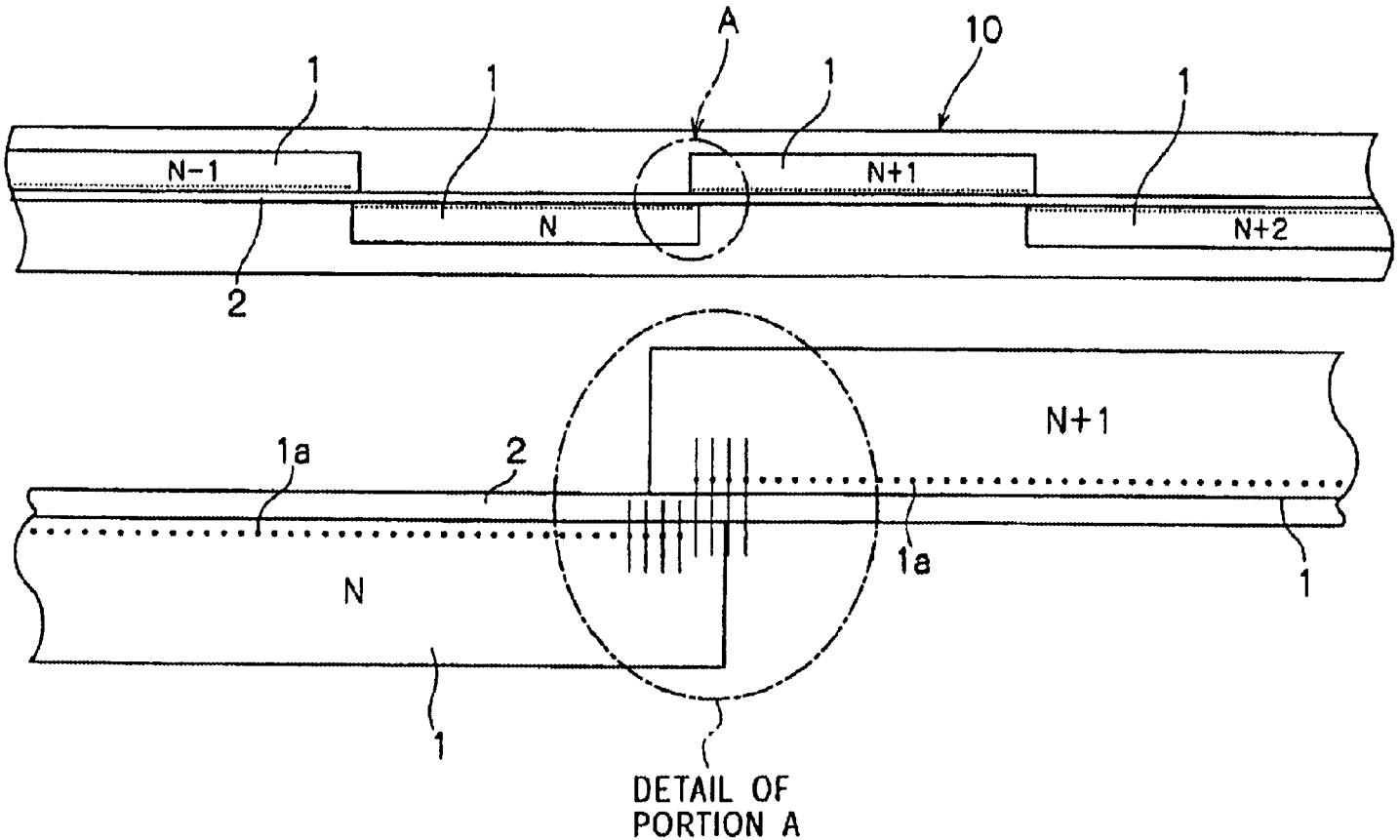
PRIOR ART FIG. 21
FIG. 21 is a plan view showing a line head of the related art.

When a plurality of heads 11 are arranged in the width direction of printing paper to form a line head as shown in FIG. 21, after the heads 11 are arranged, one nozzle sheet 17 (in which the nozzles 18 are formed in positions corresponding to all the ink cells 12 of each head chip) is bonded to the arranged heads 11 to form a line head.

Figure 2A:
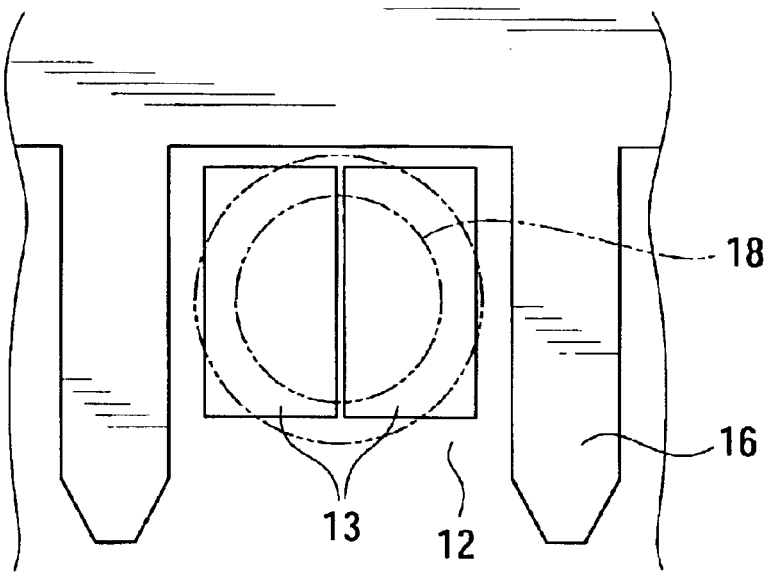
FIGS. 2A and 2B are a detailed plan view and side view showing the arrangement of heating resistors in the head shown in FIG. 1.
Figure 2B:
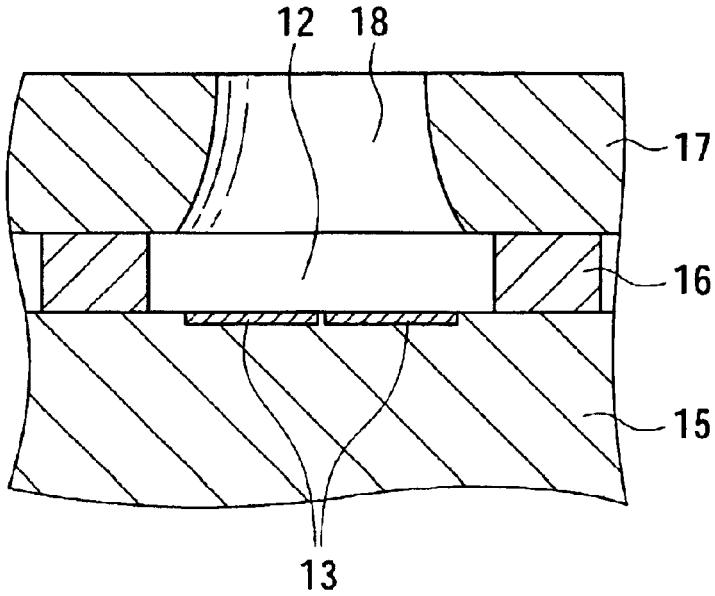

FIGS. 2A and 2B are a detailed plan view and side sectional view showing the arrangement of the heating resistors 13 in the head 11. In the plan view in FIG. 2A, the position of the nozzle 18 is indicated by the chain lines.

As shown in FIGS. 2A and 2B, in the head 11 in this embodiment, one ink cell 12 includes two separate heating resistors 13 arranged in parallel. The direction in which the heating resistors 13 are arranged is a direction (the horizontal direction in FIGS. 2A and 2B) in which the nozzles 18 are arranged.

In such a bisected type in which one heating resistor 13 is longitudinally separated, each separated heating resistor 13 has the same length and a half width. Thus, the resistance of the separated heating resistors 13 is double that of the original heating resistor 13. By connecting the separated heating resistors 13 in series, the separated heating resistors 13 having the double resistances are connected in series, so that the total resistance is four times that of the original heating resistor 13. This value is obtained when the interval (gap) of each pair of the arranged heating resistors 13 is not taken into consideration.

Here, in order that the ink in the ink cell 12 may boil, the heating resistors 13 must be heated by supplying a certain amount of power to them. This is because energy generated the boil is used to eject the ink. When the resistance is small, a current to pass must be increased. However, by increasing the resistance of the heating resistors 13, the ink can be brought to a boil with a small current.

This can also reduce the size of a transistor or the like for passing the current, thus achieving a reduction in occupied space. By reducing the thickness of the heating resistors 13, the resistance can be increased. However, when considering material selected for the heating resistors 13 and its strength (durability), there is a limitation in reducing the thickness of the heating resistors 13. Accordingly, by separating the heating resistor 13 without reducing its thickness, the resistance of the heating resistors 13 is increased.

When one ink cell 12 includes the bisected heating resistors 13, it is common that the time (bubble producing time) required for each heating resistor 13 to reach a temperature for boiling the ink is set to be equal. A difference between the bubble producing times of both heating resistors 13 causes non-perpendicularity of an angle at which the ink is ejected, thus deflecting the ejected ink.

Figure 3:
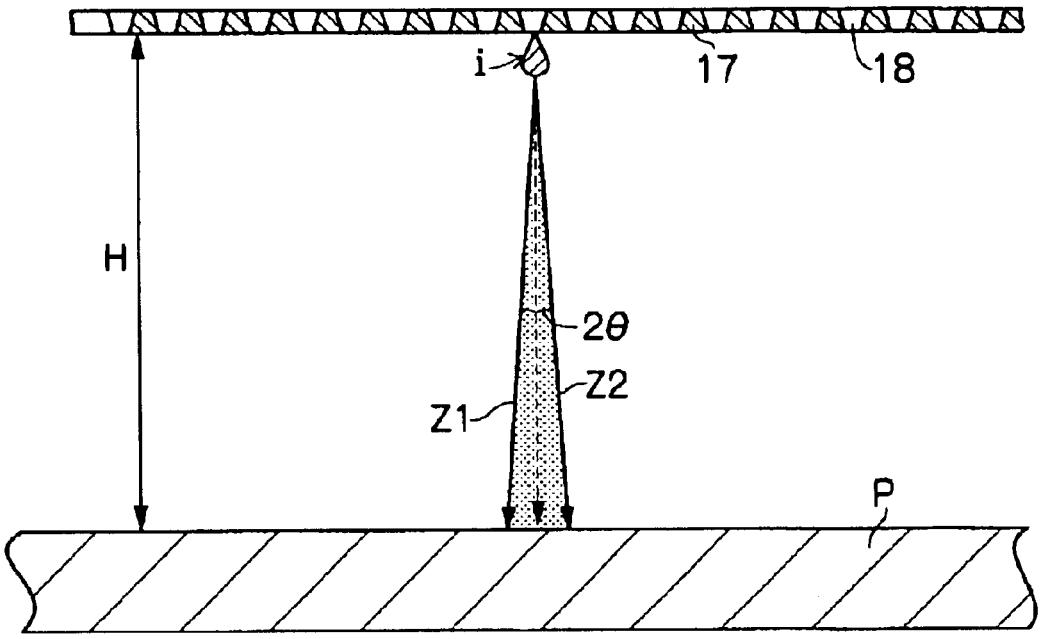
FIG. 3 is an illustration of deflection of ejected ink.

FIG. 3 is an illustration of deflection of ejected ink. In FIG. 3, when an ink droplet i is ejected perpendicularly to a plane of ejection on which the ink droplet i is ejected, the ink droplet i is ejected without being deflected, as indicated by the broken line. Conversely, when the direction in which the ink droplet i is ejected is changed and the angle of ejection is off from perpendicularity by 0 (direction Z1 or Z2 in FIG. 3), a position to which the ink droplet i is delivered is off by $$\Delta L = H \times \tan\theta$$

where the distance between the plane of ejection and the surface (a plane on which the ink droplet i is delivered) of printing paper P is H (H is constant).

Figure 4B:
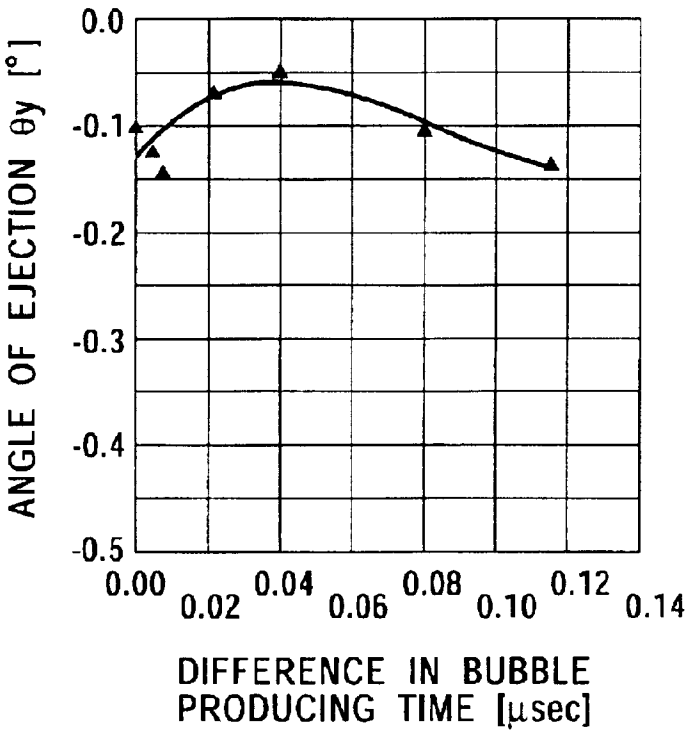
FIGS. 4A and 4B are graphs showing simulated results relationships between differences in bubble producing time of ink and the angle of ejection of ink which are obtained by divided heating resistors.
Figure 4A:
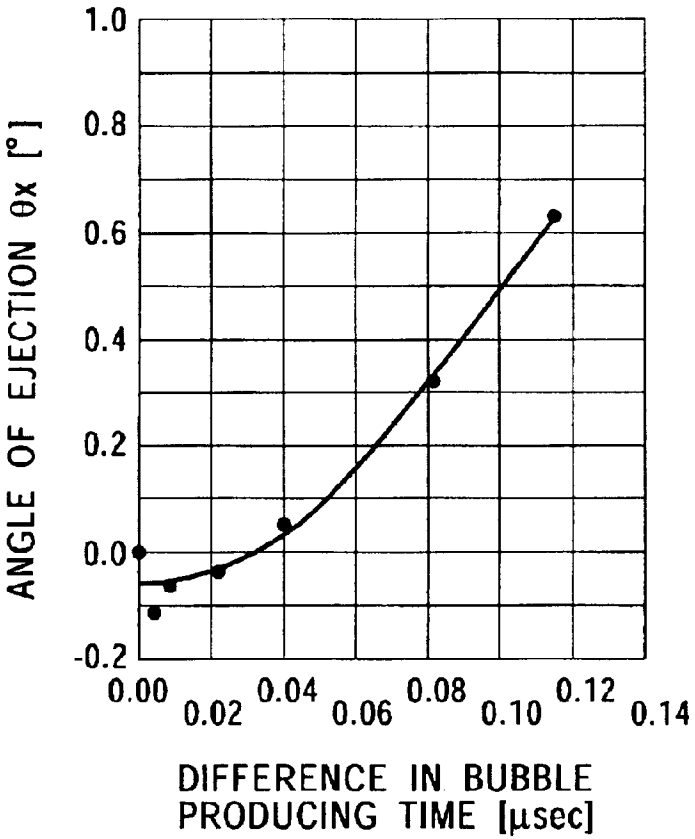
Figure 4C:
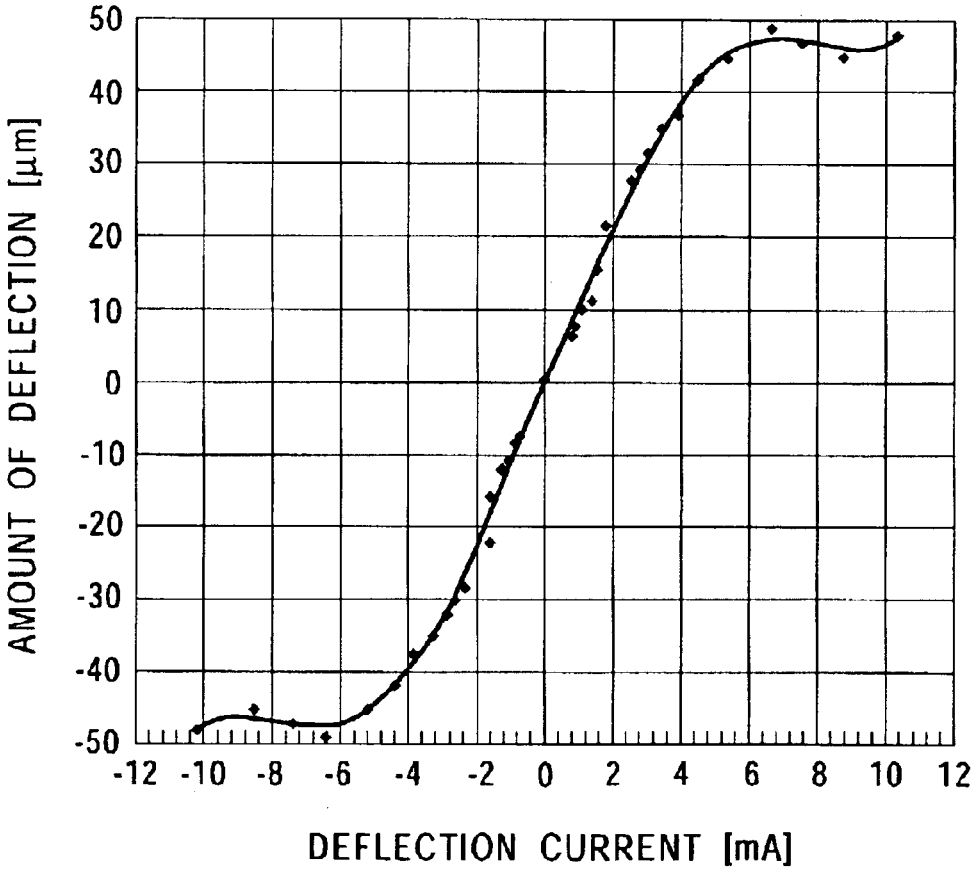
FIG. 4C is a graph showing actually measured data showing a relationship between difference in amount of current of divided heating resistors and the amount of deflection.

FIGS. 4A and 4B are graphs each showing the relationship between difference in bubble producing time of each bisected heating resistor 13 and the angle of ejection of ink, and show computer-simulated results. In each graph, the X-direction (which is an X-direction indicated by the vertical axis θ of the graph in FIG. 4A and which does not represent the horizontal axis of the graph in FIG. 4A) is a direction (the direction in which the heating resistors 13 are arranged) in which the nozzles 18 are arranged, and the Y-direction (which is a Y-direction indicated by the vertical axis θy of the graph in FIG. 4B and which does not represent the horizontal axis of the graph in FIG. 4B) is a direction (a direction in which printing paper is carried) perpendicular to the X-direction. FIG. 4C is a graph showing actually measured data, where difference in bubble producing time between the bisected heating resistors 13, that is, a deflection current, is indicated as difference in bubble producing time between the bisected heating resistors 13, and an amount of deflection (actually measured when the distance between the nozzle and a position to which ink is delivered was set at approximately 2 mm) in the position to which ink is delivered is indicated as the angle (X-direction) of ejection of ink by the horizontal axis. FIG. 4c also shows a case in which, with the main current of the heating resistors 13 set to 80 mA, the deflection current was superimposed on one of the heating resistors 13 and the ink was ejected and deflected.

When there is a time difference in production of bubbles by the heating resistors 13 bisected in the direction in which nozzles 18 are arranged, as FIGS. 4A and 4B shows, the angle of ejection of ink is not perpendicular, and the angle θx (which is a shift from perpendicularity and which corresponds to θ in FIG. 3) of ejection of ink in the direction in which the nozzles 18 are arranged increases in proportional to the difference in bubble producing time.

Accordingly, in this embodiment, by using this feature, that is, by providing the bisected heating resistors 13 (trisected heating resistors 13 in a second embodiment which is later described), and supplying different currents to the bisected heating resistors 13, a difference is set in bubble producing time of the heating resistors 13, whereby the direction in which ink is ejected is changed.

When the resistances of the bisected heating resistors 13 are not equal to each other due to, for example, a production error or the like, the heating resistors 13 have a difference in bubble producing time. Thus, the angle of ejection of ink is not perpendicular, so that the position to which the ink is delivered is off from the correct position. However, by supplying different currents to the heating resistors 13 for controlling the bubble producing time of each heating resistor 13 to be equal, the angle of ejection of ink can be set at perpendicularity.

Figures 22A, 22B:
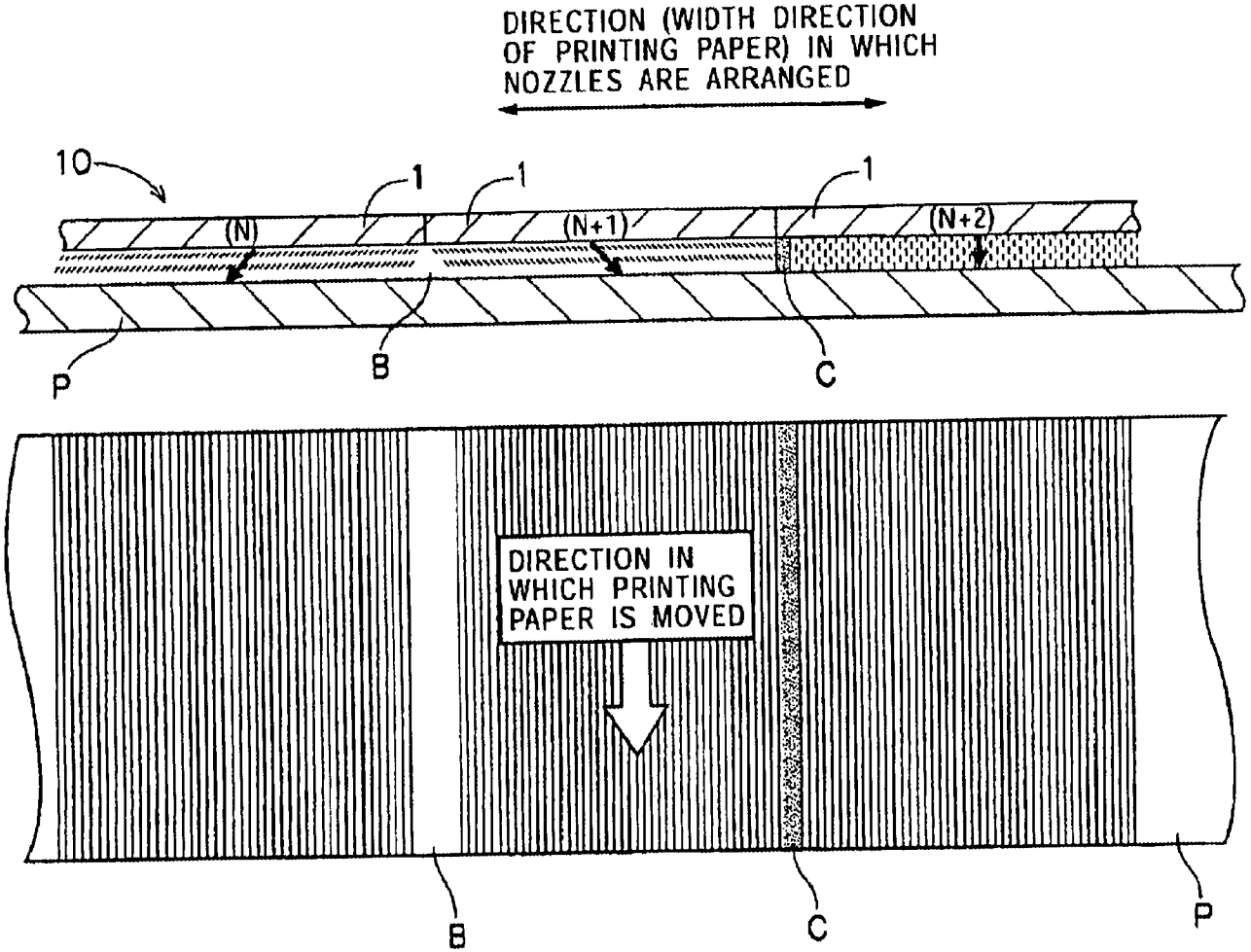
FIGS. 22A and 22B are a sectional view and plan view showing printing by the line head shown in FIG. 21.

Techniques for changing the direction of ejection of ink include, at first, changing a direction in which the entire head 11 ejects ink. Referring to FIG. 22 for example, by changing the direction of ink ejected from the N-th head to the right, the ink can be ejected perpendicularly to the surface of printing paper P, and by changing the direction of ink ejected from the (N+1)-th head 1 to the left, the ink can be ejected perpendicularly to the surface of printing paper P.

Secondly, the above techniques include changing a direction in which ink is ejected from at least one particular nozzle 18. For example, when the direction of ejection of ink from a particular nozzle 18 is not parallel to the direction of ejection of ink from the other nozzles 18, by changing the direction of ejection of ink from the particular nozzle 18, it can be corrected so as to be parallel to the direction of ejection of ink from the other nozzles 18.

Third, the direction of ejection of ink can be changed as follows:

For example, when ink droplets are ejected from adjacent nozzles N and (N+1), a position to which the ink droplet ejected from nozzle N without being deflected, and a position to which the ink droplet ejected from nozzle (N+1) without being deflected are represented by delivery position n and delivery position (n+1), respectively. In this case, the ink droplet can be ejected from nozzle N without being deflected and can be delivered to delivery position n, and can be delivered and delivered to delivery position (n+1).

Similarly, the ink droplet can be ejected from nozzle (N+1) without being deflected and can be delivered to delivery position (n+1), and can be deflected and delivered to delivery position n.

For example, when nozzle (N+1) is clogged and unable to eject an ink droplet, the ink droplet must be unable to be delivered to delivery position (n+1), so that a stuck dot is formed and the corresponding head 11 is regarded as defective.

In such a case, by using another nozzle N or nozzle (N+2), which is adjacent to nozzle (N+1), to eject and deflect an ink droplet, the ink droplet can be delivered to delivery position (n+1).

Next, means of controlling (changing) the direction of ejection of ink is described below.

In this embodiment, the bisected heating resistors 13 in the ink cell 12 are connected in series to each other. The head 11 includes a main operation controller that controls the nozzle 18 to eject an ink droplet by supplying equal currents to the connected heating resistors 13, and a sub operation controller for each ink ejecting portion which includes at least one current-mirror circuit (hereinafter referred to also as a "CM circuit") connected to a junction of both heating resistors 13 (at least one pair of heating resistors 13 when three or more heating resistors 13 are connected in series to one another), and which, by supplying a current to the heating resistors 13 through the current-mirror circuit or leading a current from the heating resistors 13, uses control of a current to each heating resistor 13 to control the direction of ejection of ink from the nozzle 18. The sub operation controller more specifically performs deflection to the direction (either direction) in which the heating resistor 13 are arranged with respect to the direction of ink ejected by the main operation controller.

The sub operation controller in this embodiment corresponds to a control means for controlling the direction of ejection of ink, or an ejection deflecting means for changing the direction of ejection of ink in the present invention.

Figure 5:
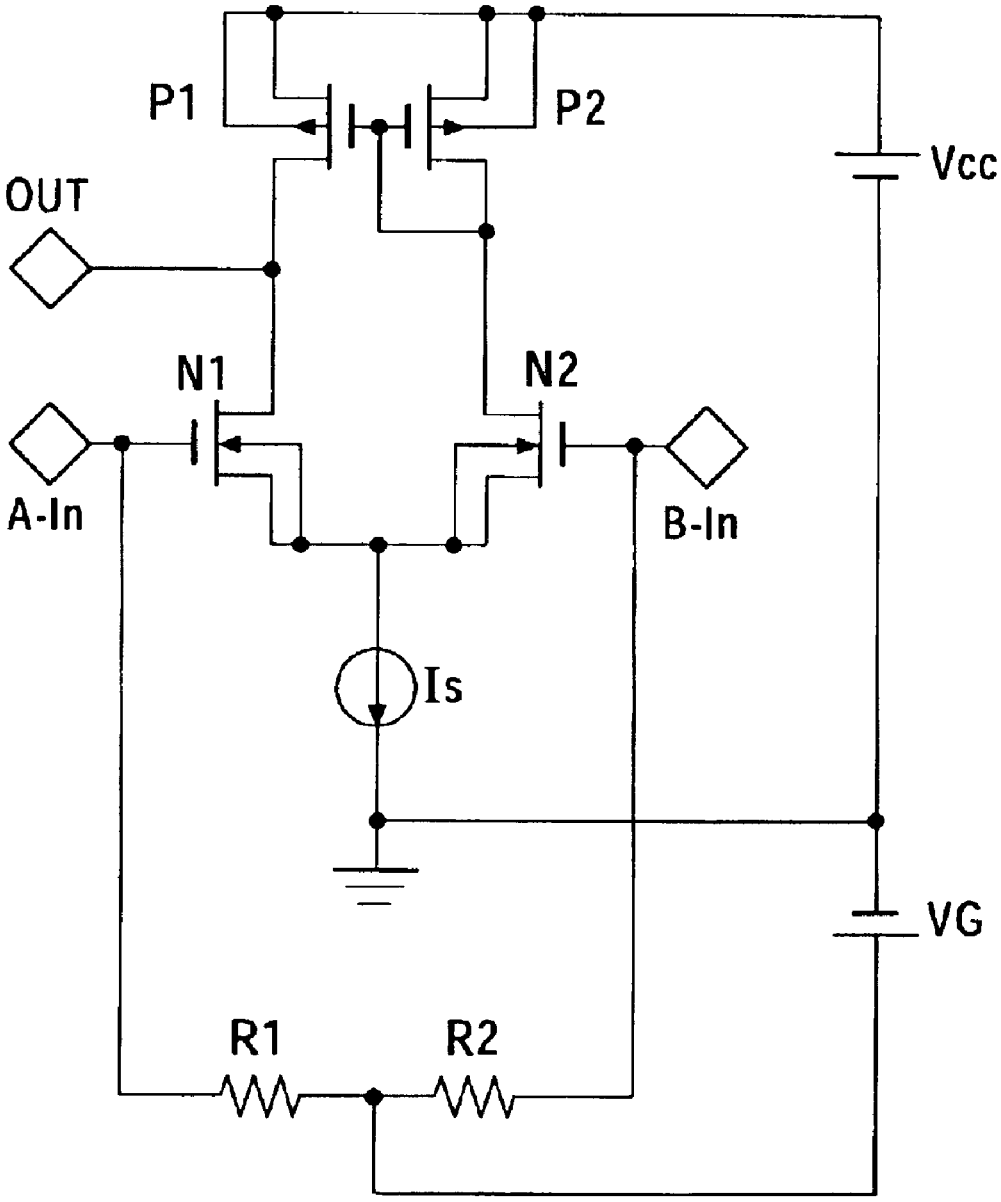
FIG. 5 is a circuit diagram showing a current-mirror circuit formed by MOS transistors.

The current-mirror circuit is briefly described below. FIG. 5 is a circuit diagram illustrating a current-mirror circuit including MOS transistors.

The current-mirror circuit is a portion of the circuit in FIG. 5 which consists of p-channel metal-oxide-semiconductor (PMOS) transistors P1 and P2. Since the gate and drain of the transistor P2 are connected to the gate of the transistor P1, equal voltages can be constantly applied to the transistors P1 and P2, and equal currents flow in them.

N-channel metal-oxide-semiconductor (NMOS) transistors N1 and N2 constitute a differential amplifier. The drains of the transistors N1 and N2 are connected to the drains of the transistors P1 and P2, respectively.

A power supply VG is used to apply a voltage to the gates of the transistors N1 and N2. A power supply Vcc is used to apply a voltage to the gates and sources of the transistors P1 and P2.

In FIG. 5, when input terminals A-In and B-In have no inputs, the transistors N1 and N2 are turned on because the voltage of the power supply VG is applied to them. In this state, a constant current supply Is supplies a current. Thus, based on the characteristics of the current-mirror circuit, equal currents flow in the transistors P1 and P2. When the flowing current is represented by Is, Is/2 flows between the transistors P1 and N1 and between the transistors P2 and N2. In this state, no current flows in or out at a terminal Out.

For example, when zero volts (OFF) is input to the terminal A-In, and 5 volts (ON) is input to the terminal B-In, the gate voltage of the transistor N1 is equal to a backgate voltage because zero volts flows ahead of the voltage of the power supply VG. This turns off the transistor N1. Conversely, the gate voltage of the transistor N2 is greater than a backgate voltage, thus turning on the transistor N2. The ON state of the transistor N2 turns on the transistors P1 and P2 because the drain of the transistor N2 is connected to the gates of the transistors P1 and P2.

At this time, the current of the constant current supply Is flows in the transistor N2 because the constant current supply Is is connected to the differential amplifier constituted by the transistors N1 and N2. Accordingly, the current of the constant current supply Is flows also in the transistor P2, and the characteristics of the current-mirror circuit cause the current of the constant current supply Is to flow also in the transistor P1. However, since the transistor N1 is in OFF state, no current flows in the transistor n1. Thus, the current of the constant current supply Is which passes through the transistor P1 flows out from the terminal Out.

For example, when 5 volts (ON) is input to the terminal A-In and zero volts (OFF) is input to the terminal B-In, the transistor N2 is turned off and the transistor N1 is turned on, conversely to the above.

When the transistor N2 is in OFF state, no current flows in the transistor P2. Also, the characteristics of the current-mirror circuit cause no current to flow in the transistors P1. However, since the current of the constant current supply Is flows in the transistor N1, a current flows in from the terminal Out, the current flows only in the transistor N1.

Figure 6:
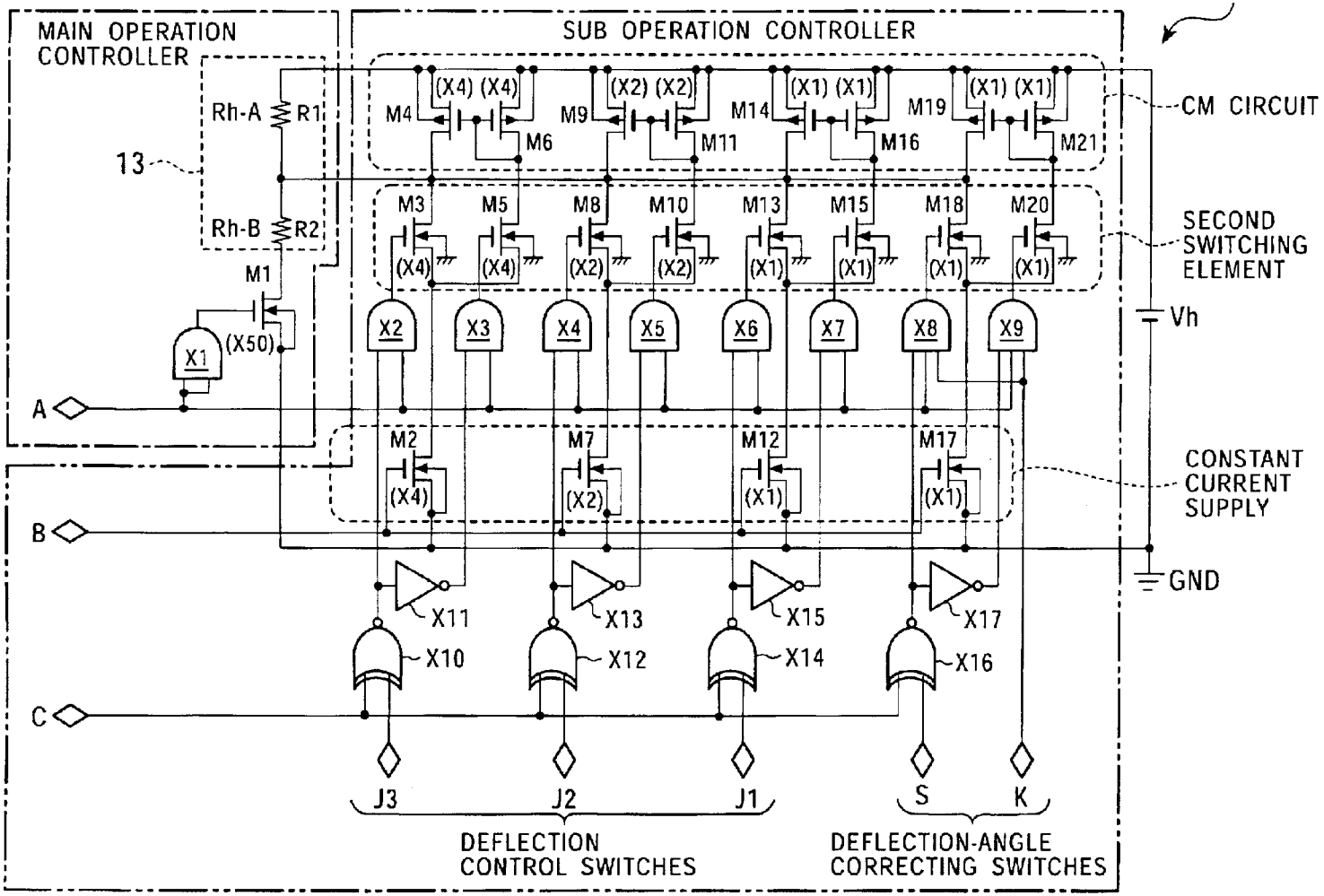
FIG. 6 is a circuit diagram showing an ejection-control circuit in a first embodiment of the present invention which includes a main operation controller and a sub operation controller including a current-mirror circuit.

FIG. 6 shows an ejection-control circuit 50 including the main operation controller, and the sub operation controller (ejection deflector) including the current-mirror circuit. In the ejection-control circuit 50 in FIG. 6, a portion corresponding to the main operation controller, and a portion corresponding to the sub operation controller is surrounded by the chain double-dashed line. At first, elements and connection states for use in the ejection-control circuit 50 are described below.

In FIG. 6, resistors Rh-A and Rh-B are the bisected heating resistors 13 and are connected in series to each other. A resistance power supply Vh is used to apply a voltage to the resistors Rh-A and Rh-B.

The ejection-control circuit 50 in FIG. 6 includes transistors M1 to M21. The transistors M4, M6, M9, M11, M14, M16, M19, and M21 are PMOS transistors, and the other transistors are NMOS transistors. Pairs of the transistors M4 and M6, M9 and M11, M14 and M16, and M19 and M21 constitute current-mirror circuits, respectively. The ejection-control circuit 50 includes four current-mirror circuits.

For example, in the current-mirror circuit composed of the transistors M4 and M6, the gate and drain of the transistor M6 are connected to the gate of the transistor M4. Thus, equal voltages are constantly applied to the transistors M4 and M6, and almost equal currents can flow in them.

The transistors M3 and M5 function as a differential amplifier, that is, a switching element (second switching element) for the current-mirror circuit composed of the transistors M4 and M6. The second switching element is used to use the current-mirror circuits to pass a current through the resistors Rh-A and Rh-B or to cause a current to flow out from the resistors Rh-A and Rh-B.

Pairs of the transistors M8 and M10, M13 and M15, and M18 and M20 are respectively second switching elements for the current-mirror circuits formed by the pairs of the transistors M9 and M11, M14 and M16, and M19 and M21.

In the current-mirror circuit composed of the transistors M4 and M6, and the second switching element formed by the transistors M3 and M5, the drains of the transistors M4 and M3 are connected to each other, and the drains of the transistors M6 and M5 are connected to each other. This also applies to the other second switching elements.

The drains of the transistors M4, M9, M14, and M19 which are parts of the current-mirror circuits, and the drains of the transistors M3, M8, M13, and M18 are connected to the midpoint of the resistors Rh-A and Rh-B.

The transistors M2, M7, M12, and M17 are used as constant current supplies for the current-mirror circuits, and their drains are respectively connected to the sources and backgates of the transistors M3, M8, M13, and M18.

The transistor M1 has a drain connected in series to the resistor Rh-B. It is turned on when an ejection-executing input switch A is in the state "1" (ON), and allows a current to flow in the resistors Rh-A and Rh-B.

The output terminals of AND gates X1 to X9 are connected to the gates of the transistors M1, M3, M5, etc. The AND gates X1 to X7 are of a two-input type, and the AND gates X8 and X9 are of a three-input type. At least one of the input terminals of the AND gates X1 to X9 is connected to the ejection-executing input switch A.

XNOR gates X10, X12, X14, and X16 each have an input terminal connected to a deflection-direction switch C, and the other input terminals of the XNOR gates X10, X12, X14, and X16 are connected to deflection-control switches J1 to J3 and a deflection-angle correcting switch S, respectively.

The deflection-direction switch C is used to switch the direction of ink-droplet ejection between the direction in which the nozzles 18 are arranged and the opposite direction thereto. When the deflection-direction switch C is in the state "1" (ON), one input of the XNOR gate X10 is "1".

The deflection-control switches J1 to J3 are used to determine an amount of deflection for changing the direction of ink-droplet ejection. For example, when an input terminal J3 is in the state "1" (ON), one input of the XNOR gate X10 is "1".

The output terminal of each of the XNOR gates X10, . . . , X16 is connected to one input terminal of each of the AND gates X2, . . . , X8 and is connected by each of NOT gates X1, . . . , X17 to one input terminal of each of the AND gates X3, . . . , X9. One input terminal of each of the AND gates X8 and X9 is connected to an ejection-angle correcting switch K.

A deflection-amplitude control terminal B is used to determine a current for the transistors M2, . . . , M17 used as the constant current supplies for the current-mirror circuits, and is connected to the gate of each of the transistors M2, . . . , M17. Since the application of an appropriate voltage (Vx) to the deflection-amplitude control terminal B supplies a gate-source voltage (Vgs) to the gates of the transistors M2, . . . , M17, currents flow in the transistors M2, . . . , M17. Here, the transistors M2, . . . , M17 have different numbers of transistors connected in parallel thereto. Thus, in FIG. 6, in each ratio indicated by the parenthesized number in each of the transistors M2, . . . , M17, for example, a current flows from the transistor M3 to M2, and a current flows from the transistor M8 to M7.

The source of the transistor M1 connected to the resistor Rh-B, and the sources of the transistors M2, . . . , M17 which are used as constant current supplies for the current-mirror circuits are connected to ground (GND).

In the above configuration, the parenthesized representation "XN" (N=1, 2, 4, or 50) in each of the transistors M1 to M21 represents a parallel state of element. For example, the representation "X1" (M12, . . . , M21) represents a standard element. The representation "X2" (M7, . . . , M11) represents an element equivalent to one in which two standard elements are connected in parallel. In other words, the representation "XN" represents an element equivalent to one in which N elements are connected in parallel.

The transistors M2, M7, M12, and M17 have the representations "X4", "X2", "X11", and "X1", respectively. Thus, by applying an appropriate voltage across the gate and ground of each transistor, their drain currents are in the ratio of 4:2:1:1.

Next, regarding the operation of the ejection-control circuit 50, at first, the current-mirror circuit composed of the transistors M4 and M6, and the transistors M3 and M5 used as a switching element therefor are described below.

The ejection-executing input switch A is in the state "1" (ON) when an ink droplet is ejected. In this embodiment, one head 11 is provided with (64×5=) 320 nozzles 18. The 320 nozzles 18 are divided into five ejection blocks each having 64 nozzles 18.

Figure 7:
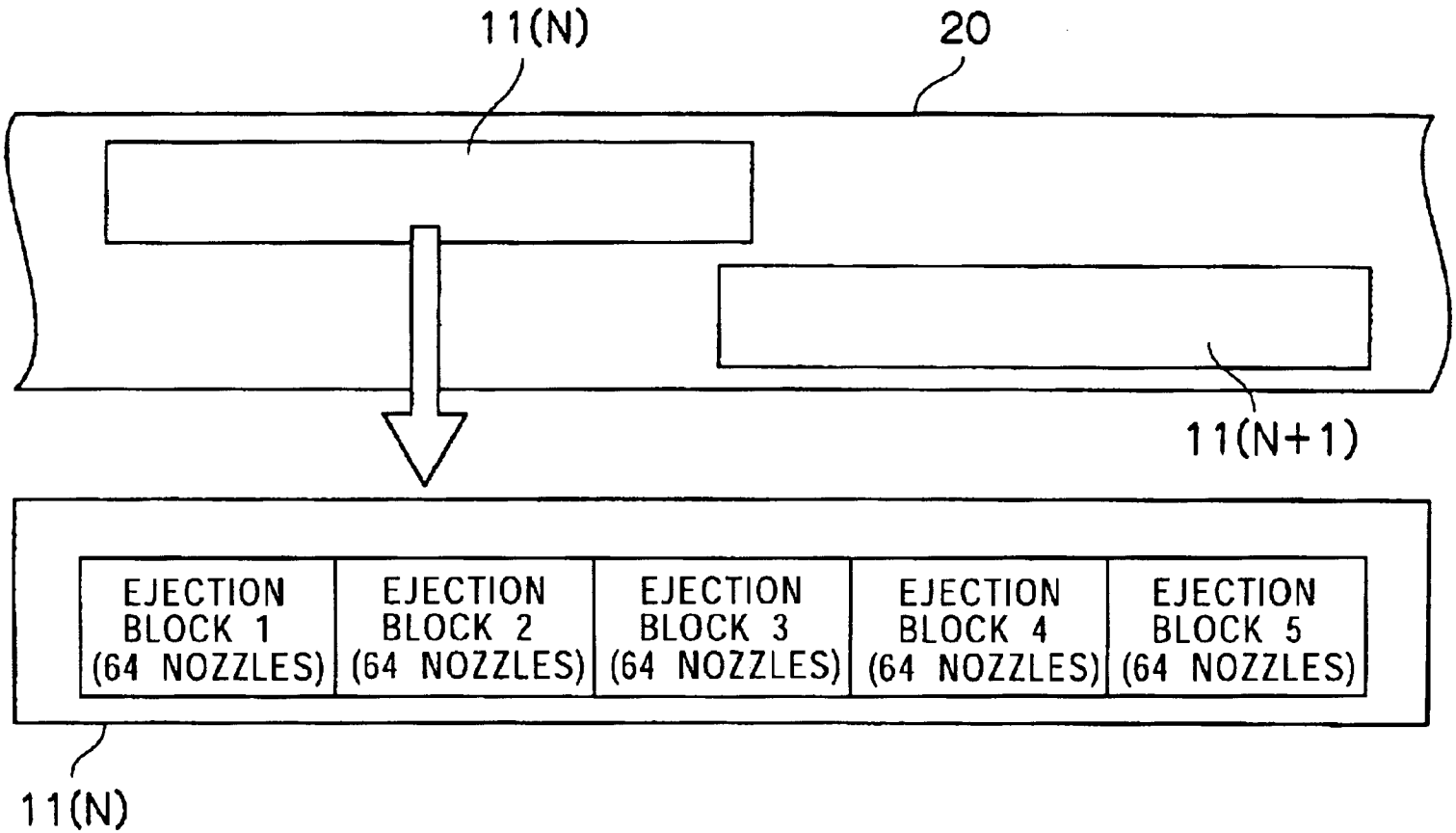
FIG. 7 is a plan view showing the structure of a line head in the first embodiment.

FIG. 7 is a plan view showing a line head 20 in this embodiment. The line head 20 is formed by arranging the heads in FIG. 1 in parallel in the width direction of printing paper. The arrangement of the heads 11 is similar to that shown in FIG. 21. In the example shown in FIG. 7, each head 11 has 320 nozzles 18 arranged in parallel. Each set of 64 nozzles 18 is used as an ejection block and ink ejection is controlled in units of blocks. In the example in FIG. 7, the nozzles 18 are divided into five blocks.

In this embodiment, when an ink droplet is ejected from one nozzle 18, the ejection-executing input switch A is set to be in the state "1" (ON) during a period of 1.5 microseconds (1/64), and the resistor power supply Vh (5 V) supplies power to the resistors Rh-A and Rh-B. 94.5 microseconds (63/64) are assigned to a period in which an ink cell 12 having ejected an ink droplet is filled with ink, with the ejection-executing input switch A set to be in the state "0" (OFF).

For example, when the ejection-executing input switch A is in the state "1", the deflection-amplitude control terminal B has the voltage Vx (analog voltage), the deflection-direction switch C is in the state "1", and the deflection-control switch J3 is in the state "1", the output of the XNOR gate is "1". Thus, this output "1" and the state "1" of the ejection-executing input switch A are input to the AND gate X2, and the output of the AND gate X2 is 1. Hence, the transistor M3 is turned on.

When the output of the XNOR gate is "1", the output of the NOT gate X11 is "0". Thus, this output "0" and the state "1" of the ejection-executing input switch A are input to the AND gate X3, so that the output of the AND gate X3 is "0" and the transistor M5 is turned off.

Accordingly, since the drains of the transistors M4 and M3 are connected to each other and the drains of the transistors M6 and M5 are connected to each other, when the transistor M3 is in ON state and the transistor M5 is in OFF state, a current flows from the resistor Rh-A to the transistor M3, but no current flows to the transistor M6 due to the OFF state of the transistor M5. Also, when no current flows to the transistor M6, no current also flows to the transistor M4 due to the characteristics of the current-mirror circuit. Since the transistor M2 is in ON state, in the above case, among the transistors M3, M4, M5, and M6, a current only flows from the transistor M3 to M2.

When in this state the voltage of the resistor power supply Vh is applied, no current flows in the transistors M4 and M6, and a current flows in the resistor Rh-A. Since a current can flow in the transistor M3, a current passes through the resistor Rh-A and branches off to the transistor M3 and the resistor Rh-B. The current passing through the transistor M3 passes through the transistor M2, which is in ON state, and is led to ground. The current passing through the resistor Rh-B passes through the transistor M1, which is in ON state, and is led to ground. Thus, the relationship in flowing current between both resistors is (the current in the resistor Rh-A)>(the current in the resistor Rh-B). In other words, the effect of the sub operation control is produced while the current is flowing in the each heating element.

A case in which the deflection-direction switch C is in the state "1" has been described. Next, a case is described in which the deflection-direction switch C is in the state "0", that is, the deflection-direction switch C is set to have a different input (the other switches A and J3 are set to be in the state "1" similarly to the above).

When the deflection-direction switch C is in the state "0" and the deflection-control switch J3 is in the state "1", the output of the XNOR gate X10 is "0". This causes the AND gate X2 to have "0" and "1" as inputs, so that its output is "0". Thus, the transistor M3 is turned off.

When the output of the XNOR gate X10 is "0", the output of the NOT gate X1 is "1". Thus, the inputs of the AND gate X3 are "1" and "1", thus turning on the transistor M5.

During the ON state of the transistor M5, a current flows in the transistor M6. This and the characteristics of the current-mirror circuit cause a current to flow also in the transistor M4.

Thus, a current is supplied and flows in the resistor Rh-A, the transistors M4 and M6 by the resistor power supply Vh. All the current passing through the resistor Rh-A flows in the resistor Rh-B (the current passing through the resistor Rh-A does not branches off to the transistor M3 since it is in OFF state). All the current passing through the transistor M4 flows into the resistor Rh-B since the transistor M3 is in OFF state. The current passing through the transistor M6 flows into the transistor M5.

As described above, in a case in which the deflection-direction switch C is in the state "1", the current passing through the resistor Rh-A flows branching off to the resistor Rh-B and the transistor M3, while in a case in which the deflection-direction switch C is in the state "0", not only the current passing through the resistor Rh-A, but also the current passing through the transistor M4 flow into the resistor Rh-B. As a result, the relationship between the currents flowing in both resistors is (the current flowing in the resistor Rh-A)<the current flowing in the resistor Rh-B). The ratio is symmetrical in both cases (the switch C is in states "1" and "0").

By setting the amounts of currents flowing in the resistors Rh-A and Rh-B to differ in the above manner, a difference can be set in bubble producing time between the bisected heating resistors 13. This can change a direction in which an ink droplet is ejected.

Between the cases in which the switch C is in states "1" and "0", a direction in which an ink droplet is deflected can be symmetrically switched in position to the direction in which the nozzles 18 are arranged.

The above description applies to a case in which only the deflection-control switch J3 is switched on and off. In addition, by switching on and off the deflection-control switches J2 and J1, the amounts of the currents flowing in the resistors Rh-A and Rh-B can be finer set.

Specifically, by using the deflection-control switch J3, the current flowing in the transistors M4 and M6 can be controlled. By using the deflection-control switch J2, the current flowing in the transistors M9 and M11 can be controlled. Also, by using the deflection-control switch J1, currents flowing in the transistors M14 and M16 can be controlled.

As described above, drain currents can be supplied to the transistors M4 and M6, the transistors M9 and M11, and the transistors M14 and M16 in the ratio of 4:2:1. Therefore, by using three bits, namely, the deflection-control switches J1 to J3, the direction in which the ink droplet is deflected can be changed to eight steps in which (J1-state, J2-state, J3-state)=(0, 0, 0), (0, 0, 1), (0, 1, 0), (0, 1, 1), (1, 0, 0), (1, 0, 1), (1, 1, 0), and (1, 1, 1).

By changing the voltage applied between the gates of the transistors M2, M7, M12, and M17 and ground, the amounts of the currents can be changed. Thus, an amount of deflection in one step can be changed without changing the drain currents in the transistors in the ratio of 4:2:1.

As described above, by using the deflection-direction switch C, the deflection direction can be symmetrically changed in position to the direction in which the nozzles 18 are arranged.

Figure 8:
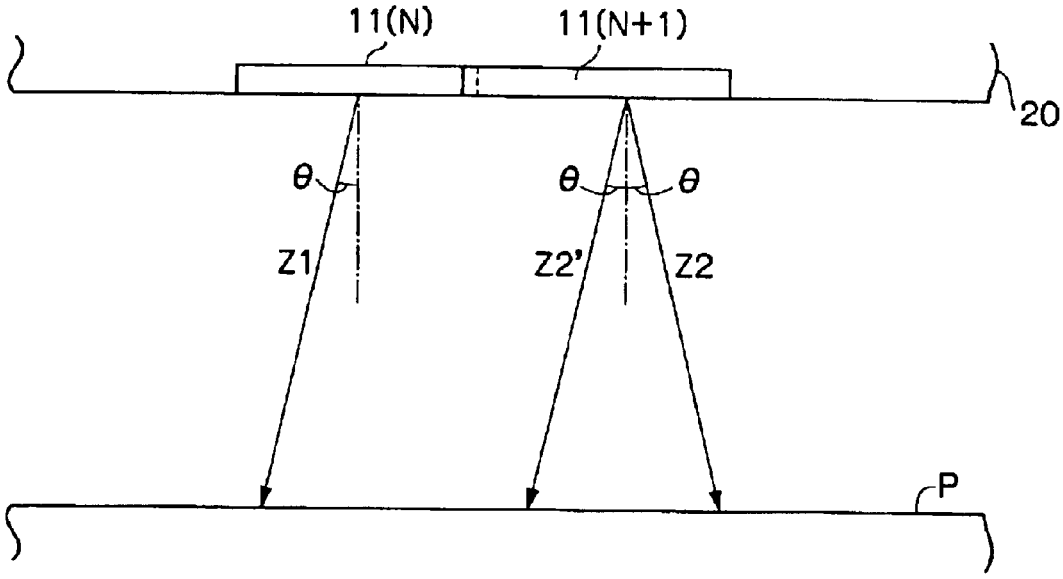
FIG. 8 is a front view showing directions in which ink droplets are ejected from adjacent heads in an alternate arrangement.

In the line head 20 in this embodiment, as in example in FIG. 8, the heads 11 are arranged in the width direction of printing paper and are arranged in a repeated pattern so that two adjacent heads 11 can oppose each other (one head 11 is disposed with it rotated 180 degrees with respect to another adjacent head 11). In this case, when a common signal is sent from the deflection-control switches J1 to J3 to the two adjacent heads 11, the deflection directions in the two adjacent heads 11 are reversed. Accordingly, in this embodiment, by providing the deflection-direction switch C, the direction of deflection in the entire head 11 can be symmetrically switched.

Accordingly, when the line head 20 is formed by arranging the heads 11 in the repeated pattern, the deflection-direction switch C is set to be in the state "0" for heads N, N+2, N+4, etc., in even-numbered positions among the heads 11, and the deflection-direction switch C is set to be in the state "1" for heads N+1, N+3, N+5, etc., whereby the direction of deflection in each head in the line head 20 can be set to be constant.

FIG. 8 is a front view showing directions in which ink droplets are ejected from adjacent heads 11 arranged in the repeated pattern. The adjacent heads 11 are referred to as heads N and N+1, respectively. If the deflection-direction switch C is not provided in this case, by setting each of the heads N and N+1 to deflect the direction of ink-droplet ejection by 0 from perpendicularity, as FIG. 8 shows, both heads have such symmetrical directions of ejection that the direction of ejection from the head N is changed to direction Z1 and the direction of ejected from the head N+1 is changed to direction Z2 because the heads N and N+1 are positioned so that one is disposed which it rotated 180 degrees with reference to another.

However, as in this embodiment, by providing the deflection-direction switch C, and, for example, setting the deflection-direction switch C to be in the state "0" for the head N and setting the deflection-direction switch C to be in the state "1" for the head N+1, the direction of ejection from the head N can be changed to direction Z1 and the direction of ejection from the head N+1 can be changed to direction Z2', so that the direction of ejection can be set to be constant in the direction in which the nozzles 18 are arranged.

As described above, by supplying identical deflection signals for the other switches and changing only the input of the deflection-direction switch C, the directions of ejection from the heads 11 arranged in the repeated pattern can be identically set.

The deflection-angle correcting switches S and K are similar to the deflection-control switches J1 to J3 in switch for changing the direction of ink-droplet ejection, but differ in switch for use in correcting an angle of ejection of ink droplet. In this embodiment, two bits which form the deflection-angle correcting switches S and K are used for correction.

The ejection-angle correcting switch K is used to determine whether or not correction is performed. The ejection-angle correcting switch K is set so that correction is performed when its state is "1" and correction is not performed when its state is "0".

The deflection-angle correcting switch S is used to determine in which direction on the arranged nozzles 18, correction is performed.

For example, when the ejection-angle correcting switch K is in the state "0" (no correction is performed), both the outputs of the AND gates X8 and X9 are "0s" since, among the three inputs of each of the AND gates X8 and X9, one input is "0". Thus, the transistors M18 and M20 are turned off, thus turning off the transistors M19 and M21. This causes no change in the currents flowing in the resistors Rh-A and Rh-B.

Conversely, when the ejection-angle correcting switch K is in the state "1", it is, for example, assumed that the deflection-angle correcting switch S is in the state "0", and the deflection-direction switch C is in the state "0", the output of the XNOR gate X16 is "1". Thus, three 1s are input to the AND gate X8 and its output is "1", turning on the transistor M18. Since one of the inputs of the AND gate X9 is set to "0" by the NOT gate X17, the output of the AND gate is "0", thus turning off the transistor M20. Therefore, the OFF state of the transistor M20 causes no current to flow in the transistor M21.

The characteristics of the current-mirror circuit cause no current to flow also in the transistor M19. However, the ON state of the transistor M18 causes a current to flow from the midpoint of the resistors Rh-A and Rh-B into the transistor M18. Thus, the current in the resistor Rh-B can be reduced than that in the resistor Rh-A. Accordingly, the angle of ejection of ink droplet is corrected and the position to which the ink droplet is delivered can be corrected by a predetermined amount in the direction in which the nozzles 18 are arranged.

The above correction is performed in units of ink ejecting portions or in units of heads 11. It is common that directions in which ink droplets are ejected from the ink ejecting portions of one head 11 are not physically identical and have some error. Normally, the range of the error is defined, and when each direction (position to which an ink droplet is delivered) of ejection of ink droplet is within a predetermined range, the direction is treated normal. However, for example, a shift in the direction in which an ink droplet is ejected from one ink ejecting portion is large compared with the other ink ejecting portions, the uniformity of an ink-droplet delivery pitch deteriorates, appearing in the form of a stripe. To correct such a positional shift, correction for each ink ejecting portion is performed (the direction of ejection is changed).

In the line head 20, each head 11 has unique ejecting characteristics. Accordingly, when there is a large shift in direction of ejection between two adjacent heads 11, the joint between the heads 11 appears as the white stripe B and superimposed stripe C shown in FIG. 22. In such a case, for the entire head 11 having a large shift in direction of ejection, the direction of ejection is performed.

Regarding correction of the direction of ink-droplet ejection, after a position to which an ink droplet is delivered can be obtained within the predetermined range by performing effective correction one, the amount of correction does not need to be changed unless the characteristics of the direction of ejection change with time.

Accordingly, it is necessary to determine for which of the ink ejecting portions of one head 11, correction must be performed, or for which of the heads 11, correction must be performed, and what amount of correction is needed in the case of requiring correction. For matching the determined correction, the deflection-angle correcting switches S and K may be turned on and off.

In the case of performing the above correction, by providing, for example, a 2-bit memory for each ink ejecting portion, when printer power is supplied, data in the memory is stored beforehand (loaded) into each head 11 in prior to the operation (printing operation) of ejecting ink droplets.

In the above embodiment, two bits formed by the deflection-angle correcting switches S and K are used to perform correction. However, by increasing the number of switches and the number of memories, finer correction can be performed.

When the direction of ink-droplet ejection is changed by using the switches J1 to J3, and S and K, the current (deflection current Idef) is represented by the following expression (1):

$$Idef=J3\times4\times Is+J2\times2\times Is+J1\times Is+S\times K\times IS=(4\times J3+2\times J2+J1+S\times K)\times Is \quad (1)$$

In the above expression, +1 or −1 is given to each of the deflection-control switches J1, J2, and J3, +1 or −1 is given to the deflection-angle correcting switch S, and +1 or −1 is given to the ejection-angle correcting switch K.

As can be understood from the above expression, setting of the deflection-control switches J1 to J3 can set the deflection current to eight levels, and the deflection-angle correcting switches S and K are used to perform correction separately from the setting of the deflection-control switches J1 to J3.

Since the deflection current can be set to four levels as positive values and four levels as negative values, the direction of ink-droplet ejection can be set to the direction in which the nozzles 18 are arranged and the opposite direction thereto. For example, in FIG. 8, with reference to the vertical direction, deflection to the left by 0 (the direction Z1 in FIG. 8) can be performed and deflection to the right by 0 (the direction Z2 in FIG. 8) can be performed. The value of 0, namely, the amount of deflection can arbitrarily be set since, by consecutively changing the voltage (used as the gate-source voltage Vgs of each of the transistors M2, M7, . . . ) of the deflection-amplitude control terminal B, the current value of each power supply is changed.

Figure 9:
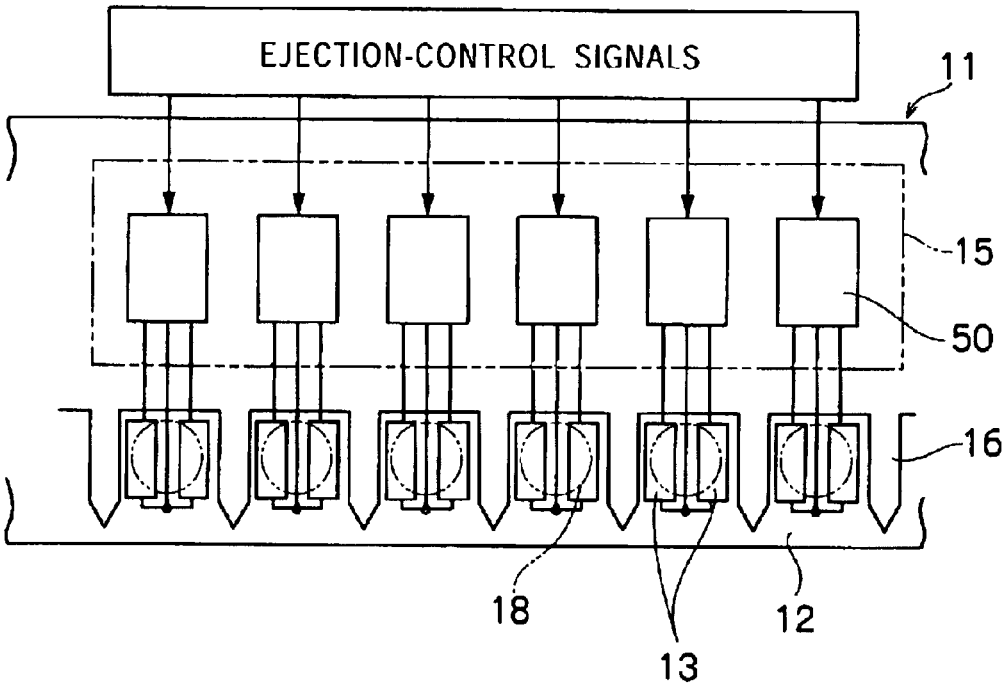
FIG. 9 is a schematic plan view showing a state in which the ejection-control circuit shown in FIG. 6 is mounted on the head shown in FIG. 1.

FIG. 9 is a plan view showing a state in which ejection-control circuits 50 as shown in FIG. 6 are provided in the head 11 in FIG. 1.

Each ejection-control circuit 50 is connected to two heating resistors 13 in each integrated circuit 12, as shown in FIG. 6. In this manner, each ink ejecting portion is provided with the ejection-control circuit 50. The ejection-control circuit 50 is mounted on the semiconductor substrate 15 described with reference to FIG. 1.

An ejection-control signal (executing) signal is input from the control unit of the printer to each ejection-control circuit 50 on the semiconductor substrate 15. The ejection-control signal controls switching of the switches (the ejection-executing input switch A, the deflection-amplitude control terminal B, the deflection-direction switch C, the deflection-control switches J1 to J3, the deflection-angle correcting switches S and K) in the ejection-control circuit 50. This ejects an ink droplet from a selected ink ejecting portion in a predetermined direction (perpendicularly to printing paper or in a direction of deflection).

In the head 11, main operation controllers and sub operation controllers (constituting ejection-control circuits 50) including current-mirror circuits are provided and a plurality of ink ejecting portions which include the main operation controllers and the sub operation controllers are arranged in parallel in an ink-droplet deflection direction (the direction in which the nozzles 18 are arranged).

Second Embodiment

Next, a second embodiment of the present invention is described below.

Although the first embodiment uses the bisected heating resistors 13, the second embodiment (described below) uses trisected heating resistors 13.

Figure 10A:
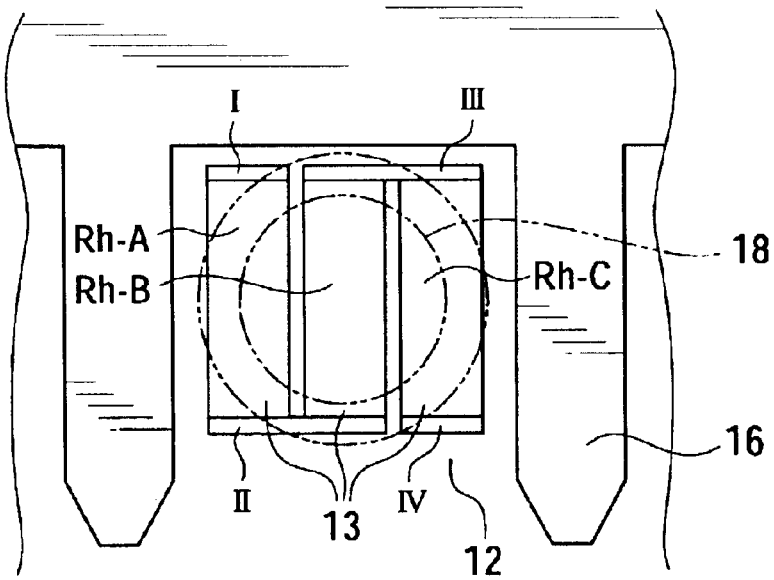
FIGS. 10A and 10B are a plan view and side sectional view showing the arrangement of heating resistors in a second embodiment of the present invention, and correspond to FIGS. 2A and 2B concerning the first embodiment, respectively
Figure 10B:
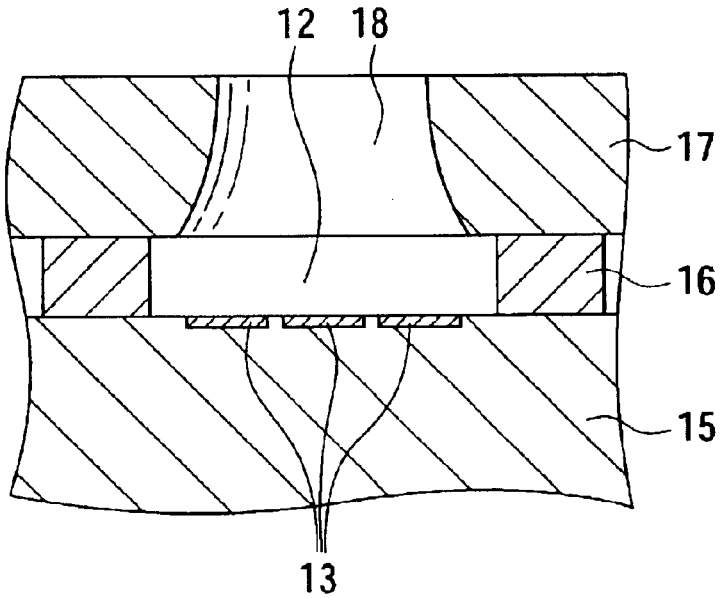

FIGS. 10A and 10B are a plan view and side sectional view showing the arrangement of heating resistors 13 in the second embodiment, and corresponds to FIGS. 2A and 2B, respectively.

Also when three or more separate heating resistors 13 are used as in the second embodiment, a direction in which the heating resistors 13 are arranged is the direction in which the nozzles 18 are arranged (the width direction of printing paper). When the three or more separate heating resistors 13 are used, they are connected in series to one another.

In FIG. 10, the trisected heating resistors 13 are referred to as resistors Rh-A, Rh-B, and Rh-C. In this case, techniques for supplying current to the heating resistors 13 include the following two techniques.

As FIG. 10A shows, when reference numerals I to IV each denote an electrode connecting adjacent resistors, (1) In a first technique, the current required for changing the direction of ink-droplet ejection is supplied so as to flow between the electrodes I and III (between the resistors Rh-A and Rh-B) or to flow between the electrodes II and IV (between the resistors Rh-B and Rh-C).

(2) In a second technique, the current required for changing the direction of ink-droplet ejection is supplied so as to flow across the electrodes I and II (in the resistor Rh-A) or to flow across the electrodes III and IV (in the resistor Rh-C).

Figure 11:
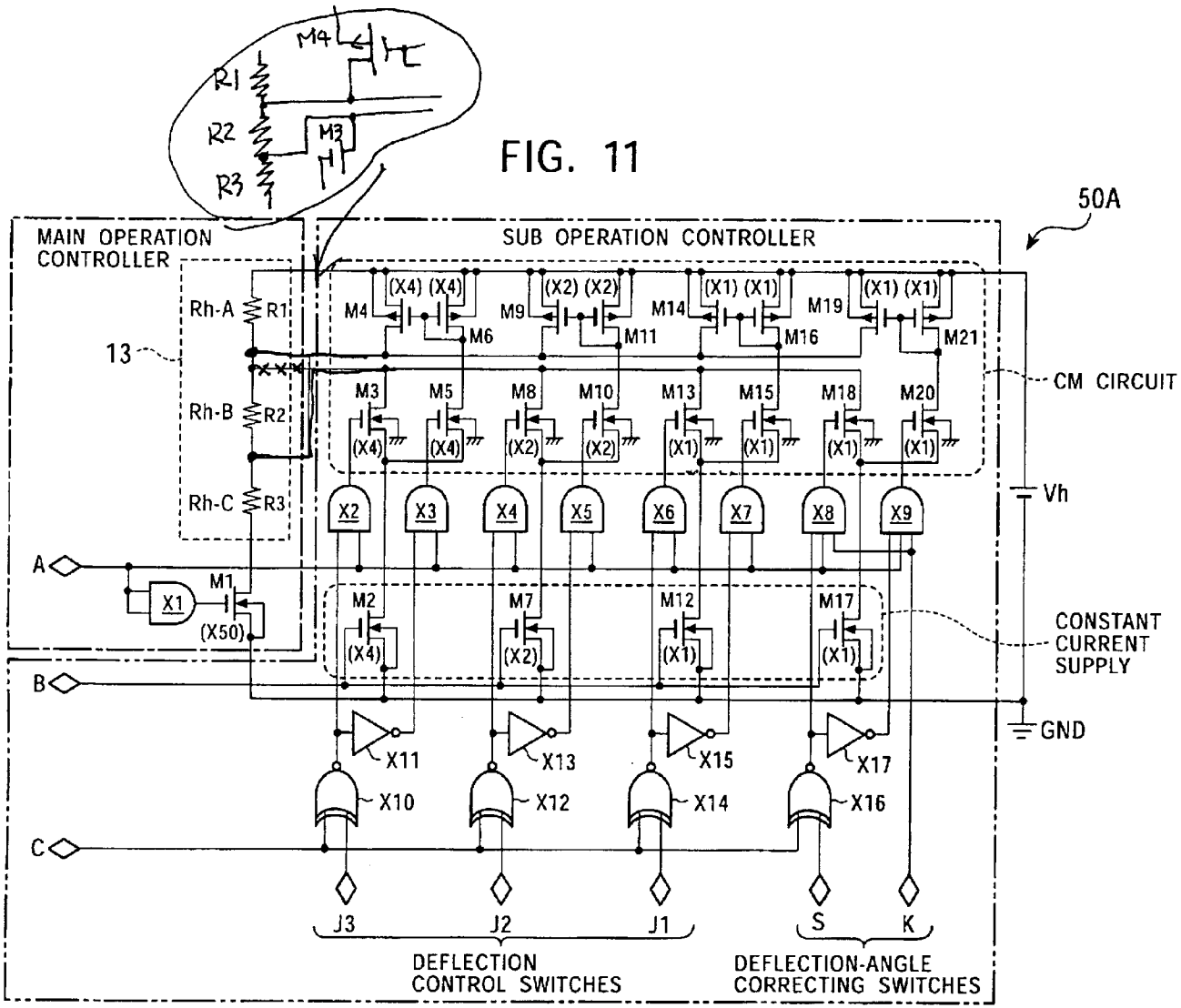
FIG. 11 is a circuit diagram showing an ejection-control circuit in the second embodiment, and corresponds to FIG. 6 concerning the first embodiment.

FIG. 11 shows an ejection-control circuit 50A in which the above first technique is employed, and corresponds to FIG. 6 which shows the ejection-control circuit 50 in the first embodiment. Differences of FIG. 11 from FIG. 6 are mainly described below.

A heating resistor 13 is formed by three resistors Rh-A, Rh-B, and Rh-C which are connected in series to one another. The resistor Rh-C is connected to the drain of the transistor M1. The drains of the transistors M4, M9, M14, and M19 are connected to the midpoint of the resistors Rh-A and Rh-B. The drains of the transistors M3, M8, M13, and M18 are connected to the midpoint of the resistors Rh-B and Rh-C. The other features are identical to those in FIG. 6 (the first embodiment).

In FIG. 11, the ejection-control circuit 50A is described with reference to only a current-mirror circuit composed of the transistors M3, M4, M5, and M6. When the switch A is in the state "1", the switch B is in the state "1", the switch C is in the state "1", and the switch is in the state "1", the output of the XNOR gate X10 is "1". Thus, this output "1" and the state "1" of the switch A are input to the AND gate X2, and its output is "1". Thus, the transistor M3 is turned on.

Also, when the output of the XNOR gate X10 is "1", the output of the NOT gate is "0". Since this output "0" and the state "1" of the switch A are input to the AND gate X3, its output is "0". Thus, the transistor M5 is turned off.

Therefore, a current flows in the transistor M3, but no current flows in the transistor M5. No current flowing in the transistor M5 causes no current to flow also in the transistor M4.

In this condition, when the voltage of the resistor power supply Vh is applied, no currents flow in the transistors M4 and M6, and a current flows in the resistor Rh-A, and a current flows also in the resistor Rh-B. Since the transistor M3 is in ON state, the current passing through the resistor Rh-B branches off to the Rh-C and the transistor M3. Thus, the currents in the resistors Rh-A, Rh-B, and Rh-C have the following relationship:

(Current in Rh-A)=(Current in Rh-B)>(Current in Rh-C)

When the deflection-direction switch C is set to be in the state "0" (the states of the switches A, B, and J3 are identical to those as described above), the output of the XNOR gate X10 is "0". This causes the AND gate X2 to have inputs "0" and "1" (the state of the switch A is "1"), so that its output is "0". Thus, the transistor M3 is turned off.

Also, when the output of the XNOR gate is "0", the output of NOT gate X11 is "1". Thus, the inputs of the AND gate X3 are "1" and "1" (the state of the switch A is "1"), thus turning on the transistor M5.

The ON state of the transistor M5 turns on the transistor M6, and the transistor M4 is also turned on based on the characteristics of the current-mirror circuit.

Thus, the resistor power supply Vh causes currents to flow respectively in the resistor Rh-A, and the transistors M4 and M6. The current passing through the resistor Rh-A flows into the resistor Rh-B. The current passing through the transistor M4 flows into the resistor Rh-B. All the current passing through the resistor Rh-B flows into the resistor Rh-C without flowing into the transistor M3 (since the transistor M3 is in OFF state). Accordingly, the currents flowing in the resistors Rh-A, Rh-B, and Rh-C have the following relationship:

(Current in Rh-A)<(Current in Rh-B)=(Current in Rh-C)

Also, in the ejection-control circuit 50A in FIG. 11,

Also, in the ejection-control circuit 50A in FIG. 11, similarly to the first embodiment in FIG. 6, in addition to turning on/off the switch J3, by turning on/off the switches J1 and J2, various setting (not described) of the currents flowing in the resistors Rh-A, Rh-B, and Rh-C can be performed. By turning on/off the switches S and K so that the currents flowing in the resistors Rh-A, Rh-B, and Rh-C, the angle of ejection can be corrected similarly to the first embodiment.

Figure 12:
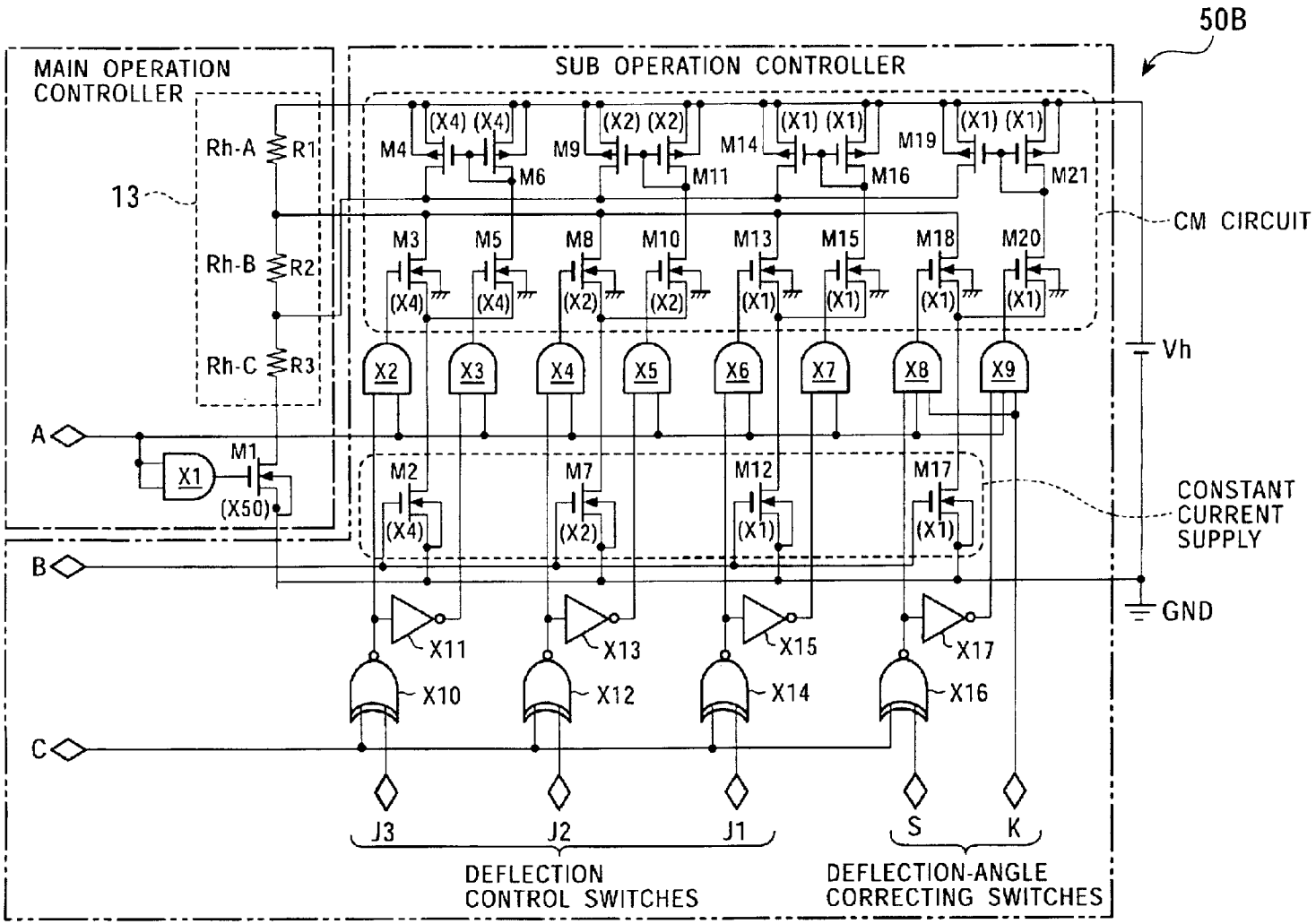
FIG. 12 is a circuit diagram showing another ejection-control circuit in the second embodiment, and corresponds to FIG. 6 concerning the first embodiment.

FIG. 12 shows an ejection-control circuit 50B using the above (2) second technique in the second embodiment, and corresponds to FIG. 6 showing the first embodiment.

In FIG. 12, the drains of the transistors M4, M9, M14, and M19 are connected to the midpoint of the resistors Rh-B and Rh-C. The drains of the transistors M3, M8, M13, and M18 are connected to the midpoint of the resistors Rh-A and Rh-B. The other connections are identical to those in FIG. 11.

In FIG. 12, the ejection-control circuit 50B is described below with reference only to a current-mirror circuit composed of the transistors M3, M4, M5, and M6. When the switch A is in the state "1", the switch B is at Vx (analog voltage), the switch C is in the state "1", and the switch J3 is in the state "1", the output of the XNOR gate X10 is "1". Thus, this output "1" and the state "1" of the switch A are input to the AND gate X2, so that its output is "1". This turns on the transistor M3.

When the output of the XNOR gate 10 is "1", the output of the NOT gate X11 is "0". Accordingly, this output "0" and the state "1" of the switch A are input to the AND gate X3, so that its output is "0", thus turning off the transistor M5.

Therefore, a current flows in the transistor M3, but no current flows in the transistor M5. While no current is flowing in the transistor M5, no current flows also in the transistor M6. The characteristics of the current-mirror circuit causes no current to flow also in the transistor M4.

In this condition, when the voltage of the resistor power supply Vh is applied, no currents flow in the transistors M4 and M6, and a current flows in the resistor Rh-A. The current passing through the resistor Rh-a branches off to the resistor Rh-B and the transistor M3 (since the transistor M3 is in ON state). The current passing through the resistor Rh-B flows in the resistor Rh-C. The OFF state of the transistor M4 causes no current to flow from the transistor M4 to the resistor Rh-C. Accordingly, the currents flowing in the resistors Rh-A, Rh-B, and Rh-C have the following relationship:

(Current in Rh-A)>(Current in Rh-B)=(Current in Rh-C)

When the switch C is in the state "0" (the states of the switches A, B, and J3 are identical to those described above), the output of the XNOR gate X10 is "0". This causes the inputs of the AND gate X2 to be "0" and "1", respectively (the switch A is in the state "1"), so that its output is "0". Thus, the transistor M3 is turned off.

The output "0" of the XNOR gate X10 causes the output of the NOT gate X11 to be "1". Thus, the inputs of the AND gate X3 are "1" and "1" (the switch A is in the state "1"), thus turning on the transistor M5.

The ON state of the transistor M5 turns on the transistor M6, and the characteristics of the current-mirror circuit also turns on the transistor M4.

Accordingly, the resistor power supply Vh causes currents to flow in the resistor Rh-A, and the transistors M4 and M6. The current passing through the resistor Rh-A does not flow in the transistor M3, but all flows into the resistors Rh-B and Rh-C. The current passing through the transistor M4 flows in the resistor Rh-C. The currents flowing in the resistors Rh-A, Rh-B, and Rh-C have the following relationship:

(Current in Rh-A)=(Current in Rh-B)<(Current in Rh-C)

Also, in the ejection-control circuit 50B in FIG. 12, similarly to the ejection-control circuit 50A in FIG. 11, in addition to turning on/off the switch J3, by turning on/off the switches J1 and J2, the currents flowing in the resistors Rh-A, Rh-B, and Rh-C can be variously set. By turning on/off the switches S and K so that the currents in the resistors Rh-A, Rh-B, and Rh-C can change, the angle of ejection can be corrected.

When the ejection-control circuit 50A in FIG. 11 and the ejection-control circuit 50B in FIG. 12 are provided in the head 11, either circuit are mounted for each ink ejecting portion.

The ejection-control circuits 50, 50A, and 50B shown in FIGS. 6, 11, and 12 have the following advantages:

(1) By using a digital input for each switch to control an analog value, a direction in which an ink droplet is delivered can be changed.
(2) As shown in FIG. 9, each circuit is suitable for the head 11, whose basic structure is an integrated circuit since it can be integrated in a digital circuit.
(3) It is difficult for each circuit to be affected by disturbance such as a change in voltage since the circuit controls the amount of current. Accordingly, in the head 11 when it employs a thermal energy method (thermal type) and a large current flows in it, stable operation is ensured.
(4) Each circuit is formed by digital circuit portions just before the final stage for ink droplet ejection. The circuit can perform stable control without being affected by an increase in its temperature, etc.
(5) In general, PMOS transistors are inferior in withstand voltage and current characteristics. However, the PMOS transistors are simply used for current-mirror circuits as in each circuit, and a voltage of ½Vh or less is always applied to each PMOS transistor since it is positioned between the junction of the resistors Rh-A and Rh-B, and the resistor power supply Vh. Accordingly, the PMOS transistors can be used without problems.

Although one embodiment of the present invention has been described, the present invention is not limited to the above embodiment, but can be variously modified as follows:

(1) In the above embodiment, three bits are used for deflection control by providing the deflection-control switches J1 to J3. However, the number of deflection-control switches is arbitrary. It is arbitrarily determined how many deflection-control switches are provided, and it is arbitrarily determined how many bits are used for deflection control. Also, in the above embodiment, two bits are used for correction of the angle of ejection of ink droplet by providing deflection-angle correcting switches S and K. However, it is arbitrarily determined how many deflection-angle correcting switches are provided, and it is arbitrarily determined how many bits are used for the correction.
(2) In the above embodiment, the transistors M2, M7, and M12 are provided so that the ratio of their drain currents is 4:2:1. However, the ratio of their drain currents is not limited to the values. Regarding transistors used as constant current supplies, any ratio of drain currents may be used. For example, the transistors M2, M7, and M12 may have 1:1:1 as the ratio of their drain currents. Similarly, regarding the transistor M17 for correcting the angle of ejection, any number of transistors M17 may be provided in accordance with the number of deflection-angle correcting switches S. When a plurality of deflection-angle correcting switches S are provided, they have an arbitrary ratio of drain currents.

In the above embodiment, the ejection-executing input switch A is used to allow a current to flow in each current-mirror circuit within a time (a period of 1.5 $\mu$s) in which ink is ejected. However, the current supply time is not limited to the period, but the current-mirror circuit may be controlled so that a current can always flow therein. For example, it is preferable in point such as power consumption that, the current be allowed to flow in a period in which an ejecting command is given or in part of the period, or in a period in which the heating resistors 13 as energy generating elements are supplied with energy for liquid ejection or part of the period. Here, the "part of the period" may be the difference in heat value in a predetermined time after activation of the ink ejecting command since it is simply required that the bisected heating resistors 13 have a difference in heat value. This is because it is not always required that a difference in heat value be produced in the entirety of the period in which the ink ejecting command is given.

The above embodiment has been described with the heating resistors 13 as an example. However, the example is not limited thereto, but any type of energy generating elements for generating energy for liquid ejection may be used.

In the above embodiment, the line head 20 for use in an inkjet printer is used as an example for description. The present invention can be applied to a serial printer in which the head 11 is used as a single unit. In the case of the head 11 as a single unit, the deflection-direction switch C is unnecessary.

The present invention can be applied to various types of liquid ejecting devices without being limited to printers. For example, the present invention can be applied to devices for ejecting DNA-contained solutions for detecting biological samples.

(7) In the above embodiment, the head 11 in which a plurality of ink ejecting portions (liquid ejection portions) are arranged in parallel is used as an example for description. However, the present invention can be applied to a liquid ejecting device provided with a single ink ejecting portion (liquid ejecting portion).

Third Embodiment

The present Inventors actually made a head having a resolution of 300 dpi in which an actual head is provided with the above-described circuits. As a result, the present Inventors have found that a large area is required by a circuit for each nozzle which deflects ejected ink since the circuit is complex. Accordingly, by further improving the above technology to achieve simplification (downsizing) of the entire circuit, the present Inventors have created the technology applied even to heads having a resolution of 600 dpi or greater.

A third embodiment of the present invention is described with reference to the accompanying drawings. In the description of the third embodiment, operations and arrangements identical to those in the first embodiment are omitted, and only portions characteristic in the third embodiment are described.

The ejection-control circuit 50 (in FIG. 6) described in the first embodiment has the following advantages:

(1) By using a digital input for each switch to control an analog value, a direction in which an ink droplet is delivered can be changed.
(2) Each circuit is suitable for the head 11, whose basic structure is an integrated circuit since it can be integrated in a digital circuit.
(3) It is difficult for each circuit to be affected by disturbance such as a change in voltage since the circuit controls the amount of current. Accordingly, in the head 11 when it employs a thermal energy method (thermal type) and a large current flows in it, stable operation is ensured.
(4) Each circuit is formed by digital circuit portions just before the final stage for ink droplet ejection. The circuit can perform stable control without being affected by an increase in its temperature, etc.
(5) In general, PMOS transistors are inferior in withstand voltage and current characteristics. However, the PMOS transistors are simply used for current-mirror circuits as in each circuit, and a voltage of ½Vh or less is always applied to each PMOS transistor since it is positioned between the junction of the resistors Rh-A and Rh-B and the resistor power supply Vh. Accordingly, the PMOS transistors can be used without problems.

When the above ejection-control circuit 50 was provided in a head 11 having a resolution of 300 dpi (an interval between nozzles 18 of 84.6 μm), no problem particularly arose. However, in this embodiment, when a head 11 having a resolution of 600 dpi (an interval between nozzles 18 of 42.3 μm) was provided with the above ejection-control circuit 50 in a head chip size almost equal to that in the case of a resolution of 300 dpi, the ejection-control circuit 50 had to be more simplified.

Figure 13:
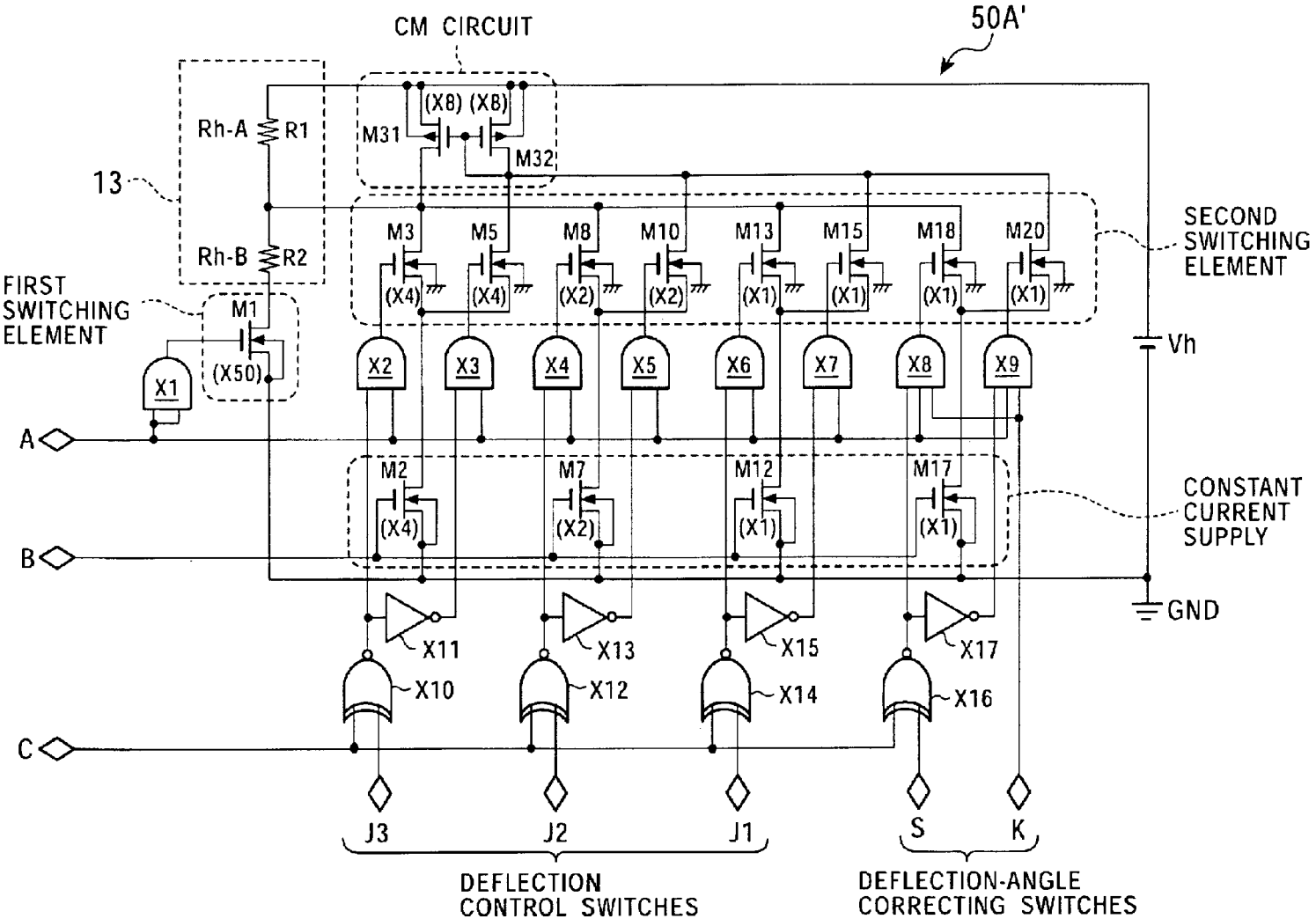
FIG. 13 is a circuit diagram showing a simplified circuit of the ejection-control circuit shown in FIG. 6.

FIG. 13 shows a simplified example (ejection-control circuit 50A) of the ejection-control circuit 50 in FIG. 6.

Although the ejection-control circuit 50 in FIG. 6 includes four current-mirror circuits, the ejection-control circuit 50A in FIG. 13 includes only a single current-mirror circuit (composed of transistors M31 and M32), whereby simplification of the entire circuit structure is achieved. In the four current-mirror circuits in FIG. 6, the transistors M4 and M6 are represented by "X4", the transistors M9 and M11 are represented by "X2", and the transistors M14 and M16 and the transistors M19 and M21 are represented by "X1", in the ejection-control circuit 50A in FIG. 13, devices represented by "X8" are used as the transistors M31 and M32 so as to have capacitance equal to those of all the above transistors in the ejection-control circuit 50.

When "X8" devices are used as the transistors M31 and M32, they have large size.

In the case of disposing transistors in a circuit, eight wiring terminals are needed for each transistor since it has a drain, a source, etc. Accordingly, compared to the case of disposing many transistors and leading eight wires from each transistor, the case of leading eight wires from a single transistor greatly reduces the required area for the entirety, even if the transistor itself is large.

Therefore, by forming a single current-mirror circuit as in the ejection-control circuit 50A in FIG. 13, the entire circuit structure can be simplified, performing functions similar to those in the ejection-control circuit 50 in FIG. 6.

Next, a dedicated circuit and a common circuit in this embodiment are described below. At first, the reason that the entire circuit can be divided into the dedicated circuit and the common circuit is described.

When an ink droplet has been ejected from an ink ejecting portion, the ejection loses ink in the ink cell 12. Accordingly, in order to fill the ink cell 12 with ink by using an ink path, it is required that the ink in the ink cell 12 be restored to a state prior to the ejection by physical inflow of ink from the periphery.

The period required for filling the ink cell 12 with ink is called a refill period and is set to be approximately $1/300000$ to $1/10000$ seconds (approximately 30 to 100 times the ejection period). Accordingly, it is impossible for each ink ejecting portion to perform consecutive ejection of ink droplets. Even if a plurality of ink ejecting portions are arranged in parallel, in a state at a given instant, each ink ejecting portion (ejection-control circuit) operates only in a portion of time.

Based on a structure in which, when each ink cell 12 is supplied with ink, the ink is supplied from an ink path which is common to ink ejecting portions, if ejection of ink from a certain ink ejecting portion produces a phenomenon in which, in the ink path, ink moves to enter the ink cell 12, the phenomenon is transmitted to the ink cell 12 of another ink ejecting portion in the form of waves. Thus, an adverse effect on the ink cell 12 of an ink ejecting portion which is adjacent to the ink ejecting portion having ejected the ink droplet cannot be ignored.

This effect specifically appears as a change (meniscus) in liquid level of the tip of the nozzle 18. When there is an effect of the operation of ejecting an ink droplet from another ink ejecting portion, in the case of ejecting an ink ejecting portion from one ink ejecting portion, the effect is a change in size of the ejected ink droplet due to a change in meniscus. Consequently, the effect appears as a change in dot size, that is, irregularity in picture quality. To avoid this problem, adjacent ink ejecting portions are prevented from being operated simultaneously or in the refill period. Accordingly, in the case of providing a common circuit for a plurality of ink ejecting portions consecutively arranged in parallel, and time-divisionally using the common circuit, no problem particularly arises.

Therefore, in the present invention, the plurality of ink ejecting portions arranged in parallel are divided into a plurality of blocks, and some ink ejecting portions are assigned to belong to each block. Dedicated circuits are provided for the ink ejecting portions, and a common circuit is provided for each block.

The common circuit is shared by all the ink ejecting portions belonging to the block. It includes at least part of the main operation controller or the sub operation controller, and is used to eject an ink droplet from any one of the ink ejecting portions belonging to the block.

Figure 14:
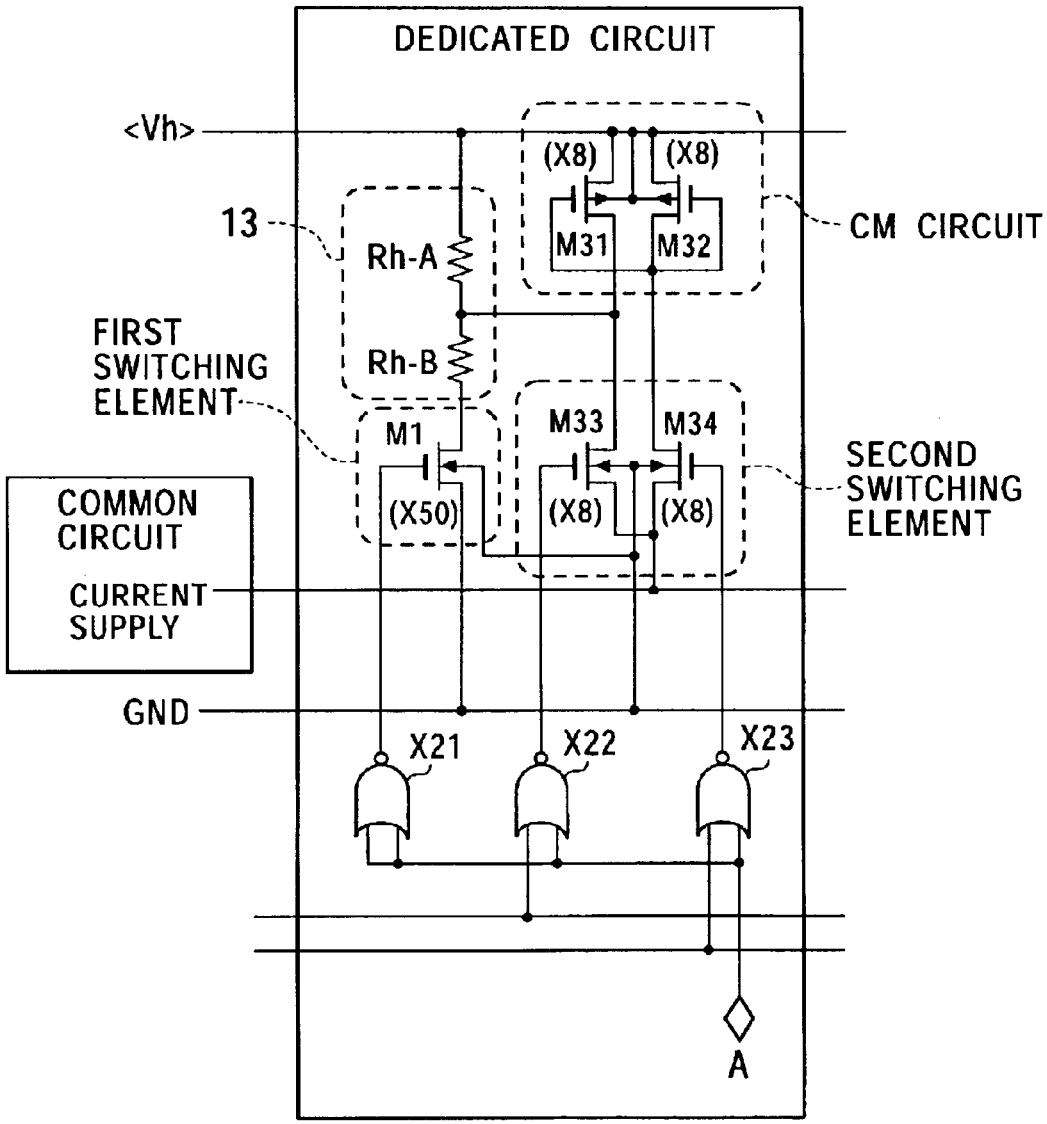
FIG. 14 is a circuit diagram showing an example of the liquid ejecting device of the present invention in which a dedicated circuit and a common circuit are provided.

FIG. 14 is a circuit diagram showing an example in which a liquid ejecting device is provided with a dedicated circuit and a common circuit. In FIG. 14, the dedicated circuit is necessary for each ink ejecting portion. The dedicated circuit in FIG. 14 includes all the parts required for the main operation controller and the part required for the sub operation controller. Conversely, regarding the common circuit, the number of common circuits which is required for the above ink ejecting portions consecutively arranged in parallel may be one. In this example, a circuit for supplying a current to a second switching element which is necessary for the sub operation controller is used as the common circuit.

In FIG. 14, resistors Rh-A and Rh-B, and a transistor M1 are identical to those shown in FIG. 13. A current-mirror circuit composed of transistors M31 and M32 is identical to that shown in FIG. 13. The switching element (second switching element) of this current-mirror circuit only consists of transistors M33 and M34. In other words, four second switching elements are not provided as in FIG. 13, and only one second switching element is provided. In FIG. 13, the transistors M3 and M5 are represented by "X4", the transistors M8 and M10 are represented by "X2", and the transistors M13 and M15 and the received signal M18 and M10 are represented by "X1". Devices represented by "X8" are used as the transistors M33 and M34 so as to have current capacitance equal to that of all the above transistors in FIG. 13.

The source and backgate of the transistor M1 are connected to ground. The sources of the transistors M33 and M34 are connected to the common circuit (current supply), and their backgates are connected to ground. NOR gates X21, X22, and X23 which are respectively connected to the gates of the transistors M1, M33, and M34, and the input terminals thereof are described later.

In the case of providing a common circuit, by increasing the number of ink ejecting portions in one block, saving in common circuit is achieved. However, at first, due to an adverse effect on a circuit in operation of the total of devices which are connected in common and which are not in operation, and an increased number of wires, the space cannot be saved as expected. Secondly, an increased number of ink ejecting portions in one common circuit reduces the number of ink ejecting portions capable of performing simultaneous ejection, thus lowering printing speed. Accordingly, an appropriate number of blocks which is suitable for the object of the liquid ejecting device must be determined. The upper limit of the number of ink ejecting portions in one common circuit is represented by (the number of all the ink ejecting portions in the head 11)/(ink ejecting portions controlled to perform simultaneous ejection).

Figure 15:
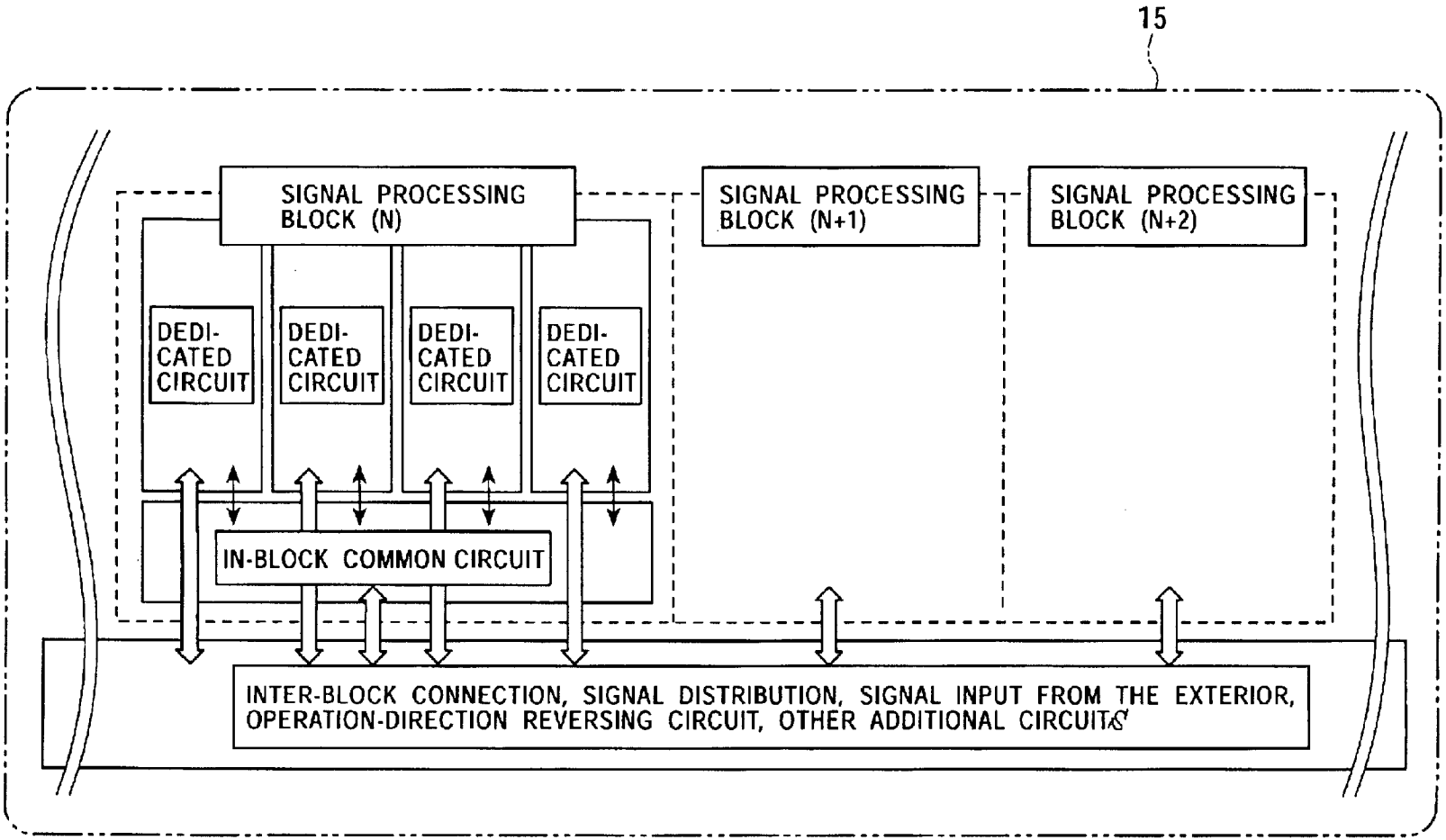
FIG. 15 is an illustration of the concepts of a dedicated circuit, a common circuit, and a block.

FIG. 15 shows the concepts of dedicated circuits, a common circuit, and blocks. Although, in the example in FIG. 15, four consecutive ink ejecting portions are treated as a block, the number of ink ejecting portions in one block is arbitrary, as described above.

As shown in FIG. 15, the four dedicated circuits are provided with one common circuit. As shown in FIG. 14, the common circuit is used as a current supply (circuit including a current-supply element) for the transistors M33 and M34, and is connected to all the dedicated circuits.

Also, for each head 11, a circuit (for controlling the entirety) connected to all the common circuits is provided and establishes connection between two blocks, distributes signals, and controls signal inputting, etc.

Next, the common circuit in this embodiment, that is, a circuit including a current-supply element for supplying currents to the transistors M33 and M34 is described below.

Figure 16A:
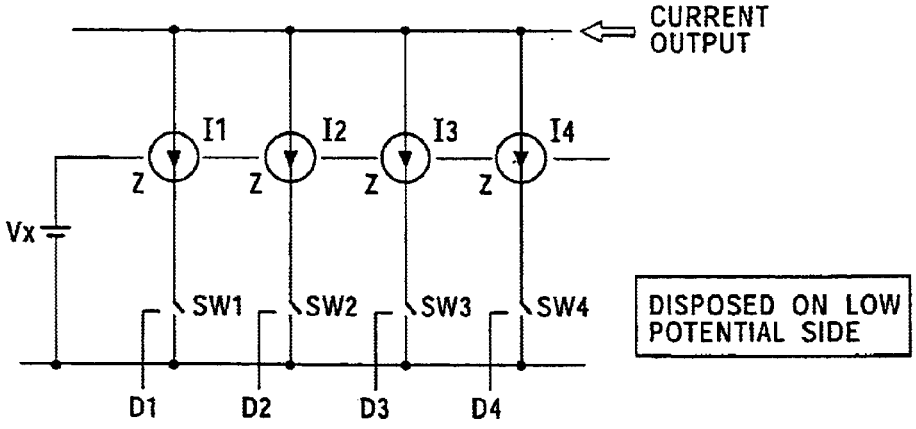
FIGS. 16A and 16B are circuit diagrams illustrating the concept of a current-supply circuit used as a common circuit in the present invention.
Figure 16B:
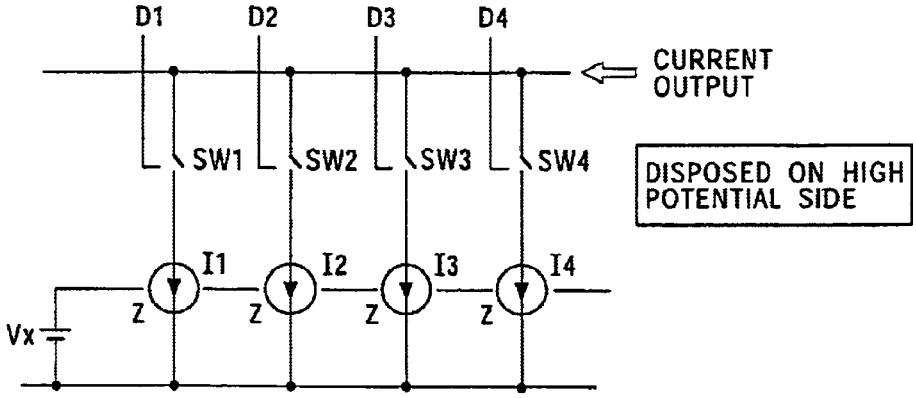

FIGS. 16A and 16B show the concept of the current-supply circuit forming the common circuit in this embodiment. In FIGS. 16A and 16B, an output current from a current supply $I_n$ (n=1, 2, . . . ) can be changed by a voltage Vx (corresponding to the voltage Vgs applied to the gates of the transistors M2, . . . , M17) applied to each Z-control terminal (corresponding to the deflection-amplitude control terminal B in FIG. 6). A change in the voltage Vx proportionally changes the output current.

Output current $I_n$ from the n-th current supply $I_n$ is represented by $$I_n=m\cdot f(Vx) \tag{2}$$

where m represents a coefficient.

When current supply In can be switched on/off by an input to each control terminal D, expression (2) can be represented by $$I_n=D\cdot m\cdot f(Vx) \tag{3}$$

where D is "1" (conduction) or "0" (non-conduction).

When n current supplies $I_n$ are connected in parallel, the total current $I_M$ of the current supplies $I_n$ is represented by $$I_M=(D_n\cdot m_n+D_{n-1}\cdot m_{n-1}+\ldots+D_1\cdot m_1)\cdot f(Vx) \tag{4}$$

where $m_n$ represents a coefficient, and $D_n$ is "1" or "0".

Accordingly, by using the common circuit represented by expression (4) and inputting "1" or "0" to each control terminal D, current $I_M$ can be changed. In addition, by changing Vx which controls f(Vx) of each current supply $I_n$, arbitrary scaling (changing the total current while maintaining an effect in percent on the entirety to be similar when controlling current by changing $D_n$) of $I_M$ can be performed.

In the case of enabling the common circuit shown in FIGS. 16A and 16B, in expression (4), control is preferable in which the coefficient of each current supply $I_n$, that is, the binary system for weighting is used. This is because the use of the binary system produces the simplest circuit configuration and reduces devices for use.

When expression (4) is weighted by using the binary system, the result can be represented by $$I_M=(2^n\cdot D_n+2^{n-1}\cdot D_{n-1}+\ldots+2\cdot D_2+D_1)\cdot f(Vx) \tag{5}$$

Figure 17:
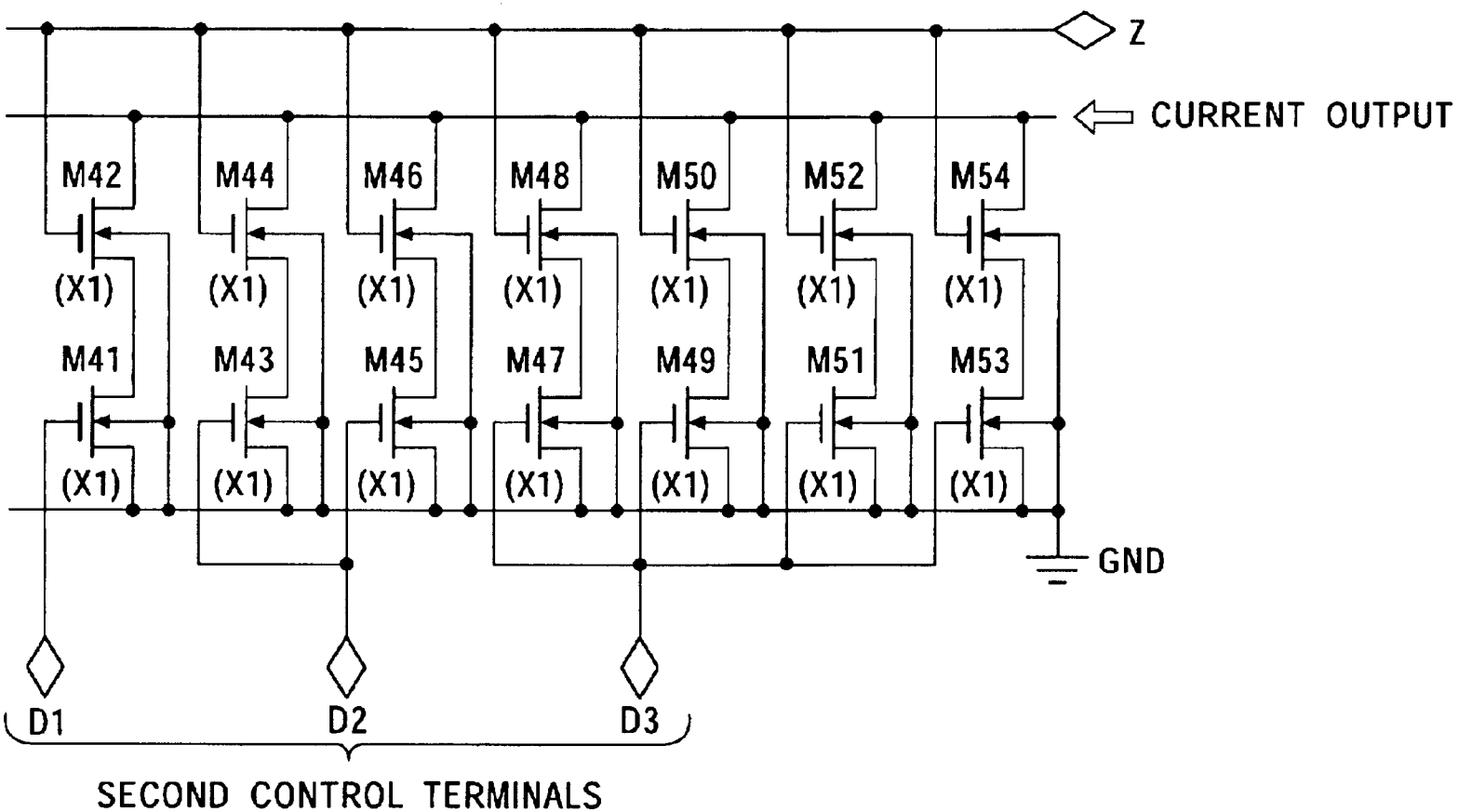
FIG. 17 is a circuit diagram showing a specific common circuit.

FIG. 17 shows a specific common circuit obtained when n=3 in expression (5). In FIG. 17, a control terminal Z corresponds to the control terminal Z in FIGS. 16A and 16B (which corresponds to a first control terminal in the present invention), and control terminals D1 to D3 correspond to the control terminals $D_n$ in FIGS. 16A and 16B (which correspond to second control terminals in the present invention).

In the common circuit in FIG. 17, current-supply elements consist of three types of current-supply elements. Specifically, the current-supply elements are formed by connecting, in parallel, (1) a current-supply element (whose input is a control terminal D1) formed by a transistor M42, (2) a current-supply element (whose input is a control terminal D2) composed of two transistors M44 and M46, and (3) a current-supply element (whose input is a control terminal D3) composed of four transistors M48, M50, M52, and M54.

Each current-supply element is formed by a unit element (NMOS transistor) represented by "X1" or unit elements which are connected in parallel.

Also, to each transistor constituting each current-supply element, each of transistors (transistors M41, M43, M45, M47, M49, M51, and M53) each having a current-carrying capacity (Id-Vgs characteristic) equal to that of the transistor are connected as each switching element for the current-supply element, and the control terminals D1 to D3 are connected to the gates of the transistors constituting the switching elements.

In expression (5), when n=3, $$I_M=(4\cdot D3+2\cdot D2+D1)\cdot f(Vx) \quad (6)$$

In FIG. 17, similarly to the case in FIGS. 16A and 16B, when the appropriate voltage Vx is applied between the control terminal Z and ground, and "1" is input to the control terminal D1, the transistor M41 is turned on, thus causing the transistor M42 to have a potential which is almost equal to the potential of ground, so that a drain current Id which is obtained when a gate voltage of approximately Vx is applied flows in the transistor M42.

Therefore, if the inputs to the control terminals are 0s, $$I_M=I_d$$

Also, when "1" is input to the control terminal D2 instead of the control terminal D1, two transistors M43 and M45 are simultaneously turned on, thus allowing a current double that obtained when the control terminal D1 is in ON state.

Therefore, when the inputs to the control terminals D1 and D3 are 0s, $$I_M=2\cdot I_d$$

Similarly, by setting only the input to the control terminal D3 to be "1", four transistors M47, M49, M51, and M53 are simultaneously turned on, thus allowing a current four times that obtained when only the control terminal D1 is "1".

Thus, $$I_M=4\cdot I_d$$

Accordingly, when the control terminals D1, D2, and D3 are separately operated, $$I_M=(4\cdot D3+2\cdot D2+D1)\cdot I_d \quad (7)$$

In other words, by separately operating the control terminals D1 to D3, $I_M$ can be controlled in eight steps (represented by 3 bits) from 0 ($I_d$) to 7 ($I_d$), with $I_d$ used as one step. The overall current can be proportionally changed because the value of $I_d$ can be changed by changing the voltage applied to Vx.

Figure 18:
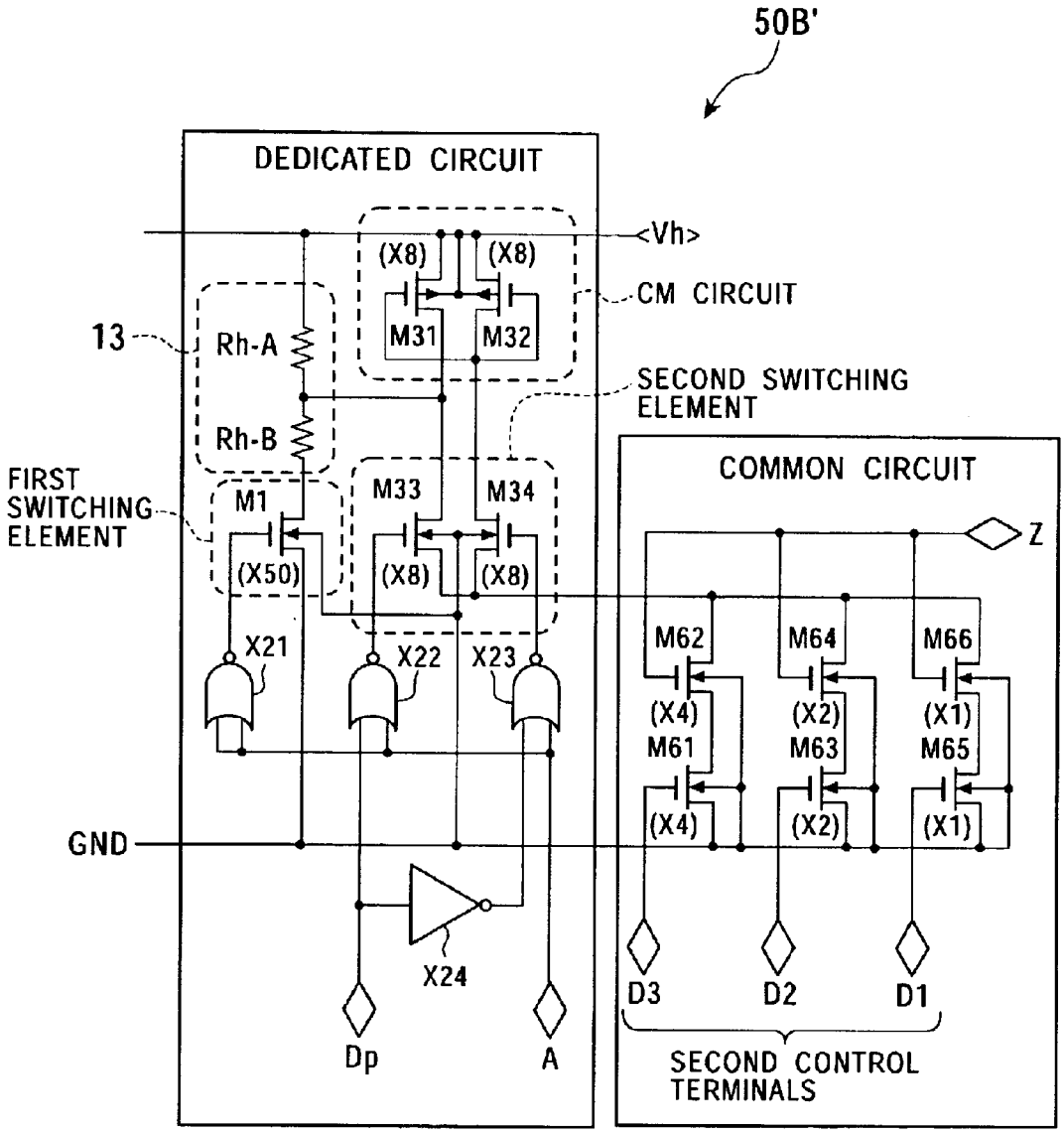
FIG. 18 is a circuit diagram showing an ejection-control circuit formed by a combination of the dedicated circuit shown in FIG. 14 and the common circuit shown in FIG. 17.

FIG. 18 shows an ejection-control circuit 50B' formed by combining the dedicated circuit in FIG. 14 and the common circuit in FIG. 17.

The ejection-control circuit 50B' differs from the dedicated circuit in FIG. 14 in that it includes a NOT gate X24 and a polarity-change switch Dp.

The ejection-control circuit 50B' differs from the common circuit in FIG. 14 in that a switching element and a current-supply element which are connected to a control terminal D3 are formed by transistors M61 and M62 each having capacity represented by "X4" and that a switching element and a current-supply element which are connected to a control terminal D2 are formed by transistors M63 and M64 each having capacity represented by "X2". The differences are such that, in order to simplify the power-supply elements (in FIG. 17) formed by unit elements (transistors) each having capacity represented by "X1" which are connected in parallel, the ejection-control circuit 50B' has structure equivalent to the transistors connected in parallel and Id-Vgs characteristics and a less number of transistors.

In the dedicate circuit in FIG. 18, an ejection-executing input switch A uses a negative logic for convenience of IC design. For activation, "0" is input to the ejection-executing input switch A. The ejection-executing input switch A in FIG. 18 is reverse in relationship to the ejection-control circuit 50 in FIG. 50.

Accordingly, for activation, "0" is input to the ejection-executing input switch A, and 0s are input to a NOR gate X21. Its output is "1", thus turning on a transistor M1.

When the input of the ejection-executing input switch A is "0", by inputting "0" to the polarity-change switch Dp, the inputs of the NOR gate X22 are "0" and "0", and the output is "1". This turns on the transistor M3. In the above case (the ejection-executing input switch A is in the state "0" and the polarity-change switch Dp is in the state "0"), the inputs of a NOR gate X23 are "1" and "0", and the output is "0", thus turning off a transistor M34.

In this case, a current flows from the transistor M31 to M33, while no current flows from the transistor M32 to M34. Based on the characteristics of the current-mirror circuit, a state in which no current flows to the transistor M32 causes no current to flow to the transistor M31.

In this state, when the voltage of the resistor power supply Vh is applied, no currents flow in the transistors M31 and M32, and a current flows in the resistor Rh-A. Since a current flows in the transistor M33, it passes through the resistor Rh-A, and branches off to the transistor M33 and the resistor Rh-B. The current passing through the transistor M33 is sent to ground. The current passing through the resistor Rh-B flows in the transistor M1, and is sent to ground. Thus, the currents in the resistors Rh-A and Rh-B has the relationship (Current in Rh-A)>(Current in Rh-B). In other words, the advantage of the sub operation control is produced in a period in which a current flows in each heating element under the main operation control.

When "0" is input to the ejection-executing input switch A and "1" is input to the polarity-change switch Dp, the inputs of the NOR gate X21 are "0" and "0" similarly to the above, and the output is "1", thus turning on the transistor M1.

Also, since the inputs of the NOR gate X22 are "1" and "0", its output is "0", thus turning off the transistor M33. Since the inputs of the NOR gate X23 are "0" and "0", its output is "1", thus turning on the transistor M34. During the ON state of the transistor M34, a current flows in the transistor M34, and this flow of the current and the characteristics of the current-mirror circuit allow a current to flow also in the transistor M31.

Thus, when the voltage of the resistor power supply Vh is applied, currents flow in the resistor Rh-A, and the transistors M31 and M32. All the current in the resistor Rh-A flows in the resistor Rh-B (the OFF state of the transistor M33 prevents the current passing through the resistor Rh-A from branching off to the transistor M33). All the current passing through the transistor M31 flows into the resistor Rh-B since the transistor M33 is in OFF state. The current in the transistor M32 flows into the transistor M34.

Therefore, in addition to the current passing through the resistor Rh-A, the current passing through the transistor M31 flows into the resistor Rh-B. As a result, the current in the resistors Rh-A and Rh-B have the relationship (Current in Rh-A)<(Current in Rh-B).

Accordingly, similarly to the ejection-control circuit 50 in FIG. 6 or the ejection-control circuit 50A in FIG. 13, a current can be led from between the resistors Rh-A and Rh-B and a current can flow between the resistors Rh-A and Rh-B.

Next, differences between the ejection-control circuit 50 in FIG. 6 and the ejection-control circuit 50B' in FIG. 18 are described below.

The ejection-control circuit 50 in FIG. 6 does not have any function of switching on/off each current-supply circuit itself. Accordingly, the state of the second switching element is any one of three states, the state "0" preventing a current from flowing, and the states "+" and "−" each allowing a current to flow.

However, only when no ejection command is issued (on standby) does the second switching element take a substantial state of "0". When the second switching element is in operation, the output of the second switching element, that is, current $I_M$ is represented as follows:

$$I_M=(4\cdot J3+2\cdot J2+J1)\cdot I_d \tag{8}$$

where expression (8) is similar to expression (7), but in expression (8), each of J1 to J3 is +1 or −1.

Accordingly, $I_M$ is one of the eight values −7, −5, −3, −1, +1, +3, +5, and +7 in a form in which it changes by 2 from −7 to +7 ($\times I_d$).

Unlike the ejection-control circuit 50 in FIG. 6, since the ejection-control circuit 50B' include the polarity-change switch Dp in addition to the three control terminals D1, D2, and D3, four bits are used on the whole, and the output current $I_M$ is represented as follows:

$$I_M=Dp\cdot(4\cdot D3+2\cdot D2+D1)\cdot I_d \tag{9}$$

where Dp and D1 to D3 each represent 1 or 0.

Therefore, in expression (9), $I_M$ is one of fifteen values from −7 to +7 ($\times I_d$) in a form in which it changes by 1. $I_M$ in expression (9) changes differently from that in expression (8).

This is because all the inputs of the control terminals D1 to D3 are 0s. In the case complying with expression (9), the number of settable current values $I_M$ is odd, including zero.

Figure 19:
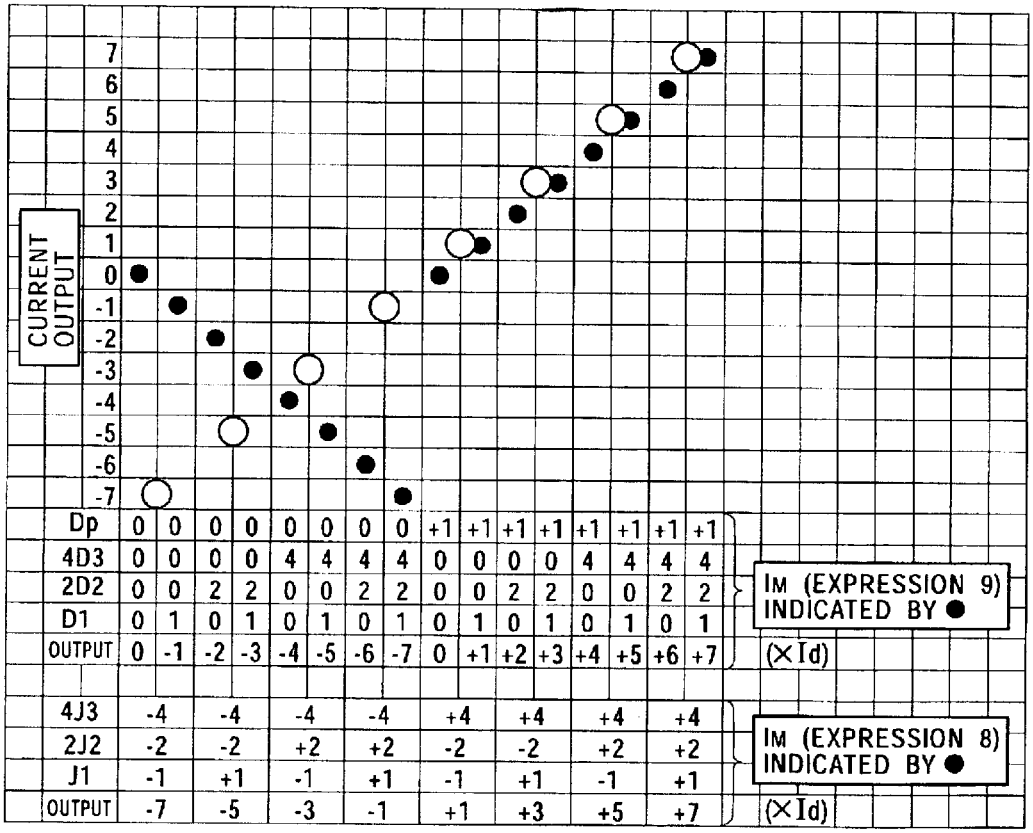
FIG. 19 is an illustration of differences between a current output obtained when the input of a deflection-control switch in the ejection-control circuit in FIG. 6 is changed and a current output obtained when the inputs of a control terminal and polarity-change switch shown in FIG. 18 are changed.

FIG. 19 shows differences between current output $I_M$ (expression (8)) obtained when the inputs of the deflection-control switches J1, J2, and J3 in the ejection-control circuit 50 in FIG. 6 are changed, and current output $I_M$ (expression (9)) obtained when the inputs of the control terminals D1, D2, and D3, and the polarity-change switch Dp in the ejection-control circuit 50B' are changed. In FIG. 19, the values of current output $I_M$ based on expression (8) are indicated by white circles, and the values of current output $I_M$ are indicated by block circles.

In the case of the ejection-control circuit 50 in FIG. 6, the deflection-control switches J1, J2, and J3 are changed, whereby output current $I_M$ changes to a total of an even number of values excluding zero which are positively and negatively symmetrical with respect to zero. In other words, it changes in the form of arithmetic progression and the sum of the arithmetic progressions is zero.

Conversely, in the case of the ejection-control circuit 50B' in FIG. 18, output current $I_M$ changes to a total of an odd number values which are asymmetrical. Also, after it changes from 0 to −7, it jumps to zero (the sign changes in the process of change).

This is inconvenience in controlling deflected ejection. Accordingly, expression (9) is transformed so as to be equivalent to expression (8).

At first, in expression (9), by always inputting "1" to the control terminal D1 (the state "0" of the control terminal D1 is eliminated), an even number of values of output current $I_M$ can be obtained.

In expression (9), when D1=1, $$I_M=Dp\cdot(4D3+2\cdot D2+1)\cdot I_d=(4\cdot Dp\cdot D3+2\cdot Dp\cdot D2+Dp)\cdot I_d=(4\cdot J3+2\cdot J2+J1)\cdot I_d \tag{10}$$

Figure 20:
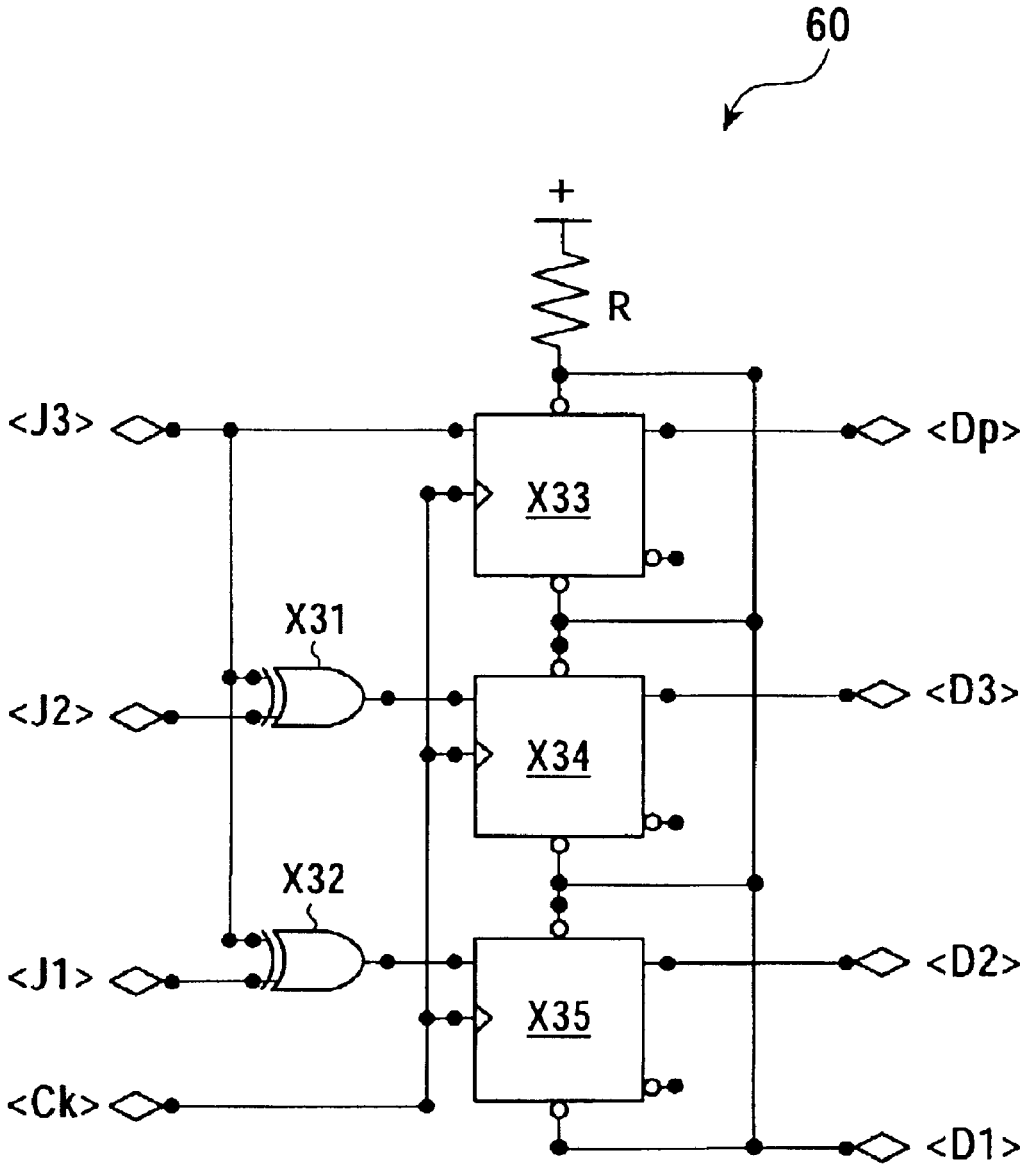
FIG. 20 is a circuit diagram showing a specific example of a sign-change circuit in the present invention.

In addition, by providing a sign changing circuit in which an equal output can be obtained in response to an equal input signal, the ejection-control circuit 50B' in FIG. 50B' is made equivalent to the ejection-control circuit 50 in FIG. 6. FIG. 20 shows a specific example of a sign-changing circuit 60 in this embodiment. In FIG. 20, similarly to the ejection-control circuit 50 in FIG. 6, input portions, namely, deflection-control switches J1, J2, and J3, and a clock-pulse (Ck) input portion are provided.

In this example, timing-establishing latches or DFFs X33 which use XOR gates X31 and X32 are provided so that the inputs of the polarity-change switch Dp and the control terminals D1 to D3 can be output. By providing the common circuit in FIG. 18 with the sign-changing circuit 60, based on the inputs of the deflection-control switches J1 to J3, output current $I_M$ takes the eight values −7, −5, −3, −1, +1, +3, +5, and +7 in a form in which it changes by 2 from −7 to +7($\times I_d$).

Accordingly, the ejection-control circuit 50B' (in FIG. 18) in this embodiment has, in addition to the advantages of the ejection-control circuit 50 in FIG. 6, the following advantages:

(1) A dedicated circuit for each ink ejecting portion can be constituted only by a current-mirror circuit and a second switching element for controlling currents in the current-mirror circuit. This can achieve simplification of circuit.
(2) In a dedicated circuit, in either a current-mirror circuit or a second switching element, the current capacity of each transistor is increased. This can reduce the area required for wiring of transistors.
(3) Since a dedicated circuit is provided with one current-mirror circuit, only two gate-voltage-controlling logic circuits are used. The number of the logic circuits can be greatly reduced.

For each block (a plurality of ink ejecting portions), only one common circuit may be provided, and only one common wiring system may be used between the common circuit and the dedicated circuit. Accordingly, wiring space is almost unnecessary.

By providing the sign-changing circuit 60 shown in FIG. 20, ease of use similar to that in a state (the ejection-control circuit 50 in FIG. 6) before division into a dedicated circuit and a common circuit can be ensured.

As a result of the above circuit simplification, the entirety of the head 11 can be small-sized, and in the case of providing the ejection-control circuit 50 in FIG. 6 to each ink ejecting portion of the head 11, a resolution of 300 dpi is a limit. However, by providing the head 11 with the ejection-control circuit 50B, a resolution of 600 dpi or higher can be realized in identical specifications.

One embodiment of the present invention has been described. However, the present invention is not limited to the above embodiments but can be variously modified as follows:

(1) Although in this embodiment the three control terminals D1 to D3 (three deflection-control switches J1 to J3 in FIG. 6) are provided, the number of control terminals is arbitrary, and it is arbitrarily determined how many switches are provided and how many bits are used for control.
(2) Although this embodiment has been described using the heating resistors 13 as an example, heating elements are not limited to the heating resistors 13, but any types of heating elements that generate thermal energy for liquid ejection may be used.

(3) In the above embodiment, the line head 20 for use in an inkjet printer is used as an example for description. The present invention can be applied to a serial printer in which the head 11 is used as a single unit. In the case of the head 11 as a single unit, the deflection-direction switch C is unnecessary.

(4) The present invention can be applied to various types of liquid ejecting devices without being limited to printers. For example, the present invention can be applied to devices for ejecting DNA-contained solutions for detecting biological samples.

What is claimed is:

1. A liquid ejecting device having a head including a liquid ejecting portion or a plurality of liquid ejecting portions arranged in parallel in a predetermined direction, said liquid ejecting portion or each of the liquid ejecting portions comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction; and said liquid ejecting device comprises:

main operation-control means which, by supplying equal amounts of currents to the connected energy generating elements in said liquid cell, performs control so that the liquid is ejected from said nozzle; and sub operation-control means provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from said nozzle is controlled.

2. A liquid ejecting device having a head including a liquid ejecting portion or a plurality of liquid ejecting portions arranged in parallel in a predetermined direction, said liquid ejecting portion or each of the liquid ejecting portions comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction; and said liquid ejecting device comprises:

main operation-control means which, by supplying equal amounts of currents to the connected energy generating elements in said liquid cell, performs control so that the liquid is ejected from said nozzle; and sub operation-control means provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from said nozzle is controlled to change with respect to a direction in which liquid is ejected by said main operation-control means.

3. A liquid ejecting device according to one of claims 1 and 2, wherein said main operation-control means and said sub operation-control means including the current-mirror circuit are mounted on the head.

4. A liquid ejecting device according to one of claims 1 and 2, wherein the liquid ejecting portions including said main operation-control means and said sub operation-control means including the current-mirror circuit are mounted on the head in a form arranged in parallel in said predetermined direction.

5. A liquid ejecting device having a line head formed by a plurality of heads arranged in a predetermined direction, the heads each being formed by a plurality of liquid ejecting portions arranged in parallel in said predetermined direction, the liquid ejecting portions each comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction; and said liquid ejecting device comprises:

main operation-control means which, by supplying equal amounts of currents to the connected energy generating elements in said liquid cell, performs control so that the liquid is ejected from said nozzle; and sub operation-control means provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from said nozzle is controlled.

6. A liquid ejecting device having a line head formed by a plurality of heads arranged in a predetermined direction, the heads each being formed by a plurality of liquid ejecting portions arranged in parallel in said predetermined direction, the liquid ejecting portions each comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction; and said liquid ejecting device comprises:

main operation-control means which, by supplying equal amounts of currents to the connected energy generating elements in said liquid cell, performs control so that the liquid is ejected from said nozzle; and sub operation-control means provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from said nozzle is controlled to change to said predetermined direction with respect to a direction in which liquid is ejected by said main operation-control means.

7. A liquid ejecting device according to one of claims 5 and 6, wherein said main operation-control means and said sub operation-control means including the current-mirror circuit are mounted on each of the heads forming said line head.

8. A liquid ejecting device according to one of claims 5 and 6, wherein the liquid ejecting portions including said main operation-control means and said sub operation-control means including the current-mirror circuit are mounted on each of the heads forming said line head in a form arranged in parallel in said predetermined direction.

9. A liquid ejecting method using a head including a liquid ejecting portion or a plurality of liquid ejecting portions arranged in parallel in a predetermined direction, said liquid ejecting portion or each of the liquid ejecting portions comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction, and at least one current-mirror circuit is connected to a junction of the energy generating elements; and the liquid from said nozzle is controlled so as to be ejected in at least two different directions by using:

a main operation-control step which, by supplying equal amounts of currents to the connected energy generating elements in said liquid cell without using said at least one current-mirror circuit, performs control so that the liquid is ejected from said nozzle; and a sub operation-control step in which, by using the current-mirror circuit to allow a current to flow into or to flow from the junction of the energy generating elements, the amount of a current supplied to each of the energy generating elements is controlled and the direction of the liquid ejected from said nozzle is controlled.

10. A liquid ejecting method using a line head formed by a plurality of heads arranged in a predetermined direction, the heads each being formed by a plurality of liquid ejecting portions arranged in parallel in said predetermined direction, the liquid ejecting portions each comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction, and at least one current-mirror circuit is connected to a junction of the energy generating elements; and the liquid from said nozzle is controlled so as to be ejected in at least two different directions by using:

a main operation-control step in which, by supplying equal amounts of currents to the connected energy generating elements in said liquid cell without using said at least one current-mirror circuit, the liquid is controlled to be ejected from said nozzle; and a sub operation-control step in which, by using the current-mirror circuit to allow a current to flow into or to flow from the junction of the energy generating elements, the amount of a current supplied to each of the energy generating elements is controlled and the direction of the liquid ejected from said nozzle is controlled.

11. A liquid ejecting device having a head including a liquid ejecting portion or a plurality of liquid ejecting portions arranged in parallel in a predetermined direction, said liquid ejecting portion or each of the liquid ejecting portions comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction; and said liquid ejecting device comprises control means provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from said nozzle is controlled.

12. A liquid ejecting device having a head including a liquid ejecting portion or a plurality of liquid ejecting portions arranged in parallel in a predetermined direction, said liquid ejecting portion or each of the liquid ejecting portions comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction; and said liquid ejecting device comprises ejection deflecting means provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the liquid ejected from said nozzle is deflected in the predetermined direction and the opposite direction thereto.

13. A liquid ejecting device according to claim 12, wherein:

said ejection deflecting means includes the current-mirror circuits, and the current-mirror circuits include at least two different current-mirror circuits having different amounts of currents flowing therein; and said ejection deflecting means gradually controls the amount of the current supplied to each of the energy generating elements by using the current-mirror circuits to allow a current to flow into or to flow from the junction of the energy generating elements.

14. A liquid ejecting device according to claim 12, wherein said at least one current-mirror circuit included in said ejection deflecting means is provided for each of the liquid ejecting portions and corrects an angle at which liquid is ejected.

15. A liquid ejecting device according to claim 12, wherein said ejection deflecting means performs control for supplying current to said at least one current-mirror circuit either in one of a period in which a liquid ejecting command is issued and part of the period, or in one of a period in which energy is supplied to the energy generating elements for ejection of liquid and part of the period.

16. A liquid ejecting device having a line head formed by a plurality of heads arranged in a predetermined direction, the heads each being formed by a plurality of liquid ejecting portions arranged in parallel in said predetermined direction, the liquid ejecting portions each comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction; and said liquid ejecting device comprises control means provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the direction of the liquid ejected from said nozzle is controlled.

17. A liquid ejecting device having a line head formed by a plurality of heads arranged in a predetermined direction, the heads each being formed by a plurality of liquid ejecting portions arranged in parallel in a predetermined direction, the liquid ejecting portions each comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction; and said liquid ejecting device comprises ejection deflecting means provided for each of the liquid ejecting portions which includes at least one current-mirror circuit connected to a junction of the energy generating elements, and in which, by using the current-mirror circuit to allow a current to flow into or to flow from the junction of the energy generating elements, the amount of a current supplied to each of the energy generating elements is controlled and the liquid ejected from said nozzle is deflected in the predetermined direction and the opposite direction thereto.

18. A liquid ejecting device according to claim 17, wherein:

among the heads, two adjacent heads in said predetermined direction are disposed across a liquid-flow path extending in said predetermined direction so that one head is positioned on one side and the other head is positioned on the other side, with both opposing each other;

said ejection deflecting means comprises deflection-direction switching means which, by controlling current supplied to said at least one current-mirror circuit, switches the direction of the liquid ejected from said nozzle between two symmetric directions with respect to said predetermined direction; and in one of the two adjacent heads in said predetermined direction, said deflection-direction switching means switches a direction in which ejected liquid is deflected to a direction which is symmetrical with respect to that obtained by the other one.

19. A liquid ejecting device according to claim 17, wherein:

said ejection deflecting means includes the current-mirror circuits, and the current-mirror circuits include at least two different current-mirror circuits having different amounts of currents flowing therein; and said ejection deflecting means gradually controls the amount of the current supplied to each of the energy generating elements by using the current-mirror circuits to allow a current to flow into or to flow from the junction of the energy generating elements.

20. A liquid ejecting device according to claim 17, wherein said at least one current-mirror circuit included in said ejection deflecting means is provided for each of the liquid ejecting portions and corrects an angle at which liquid is ejected.

21. A liquid ejecting device according to claim 17, wherein said ejection deflecting means performs control for supplying current to said at least one current-mirror circuit either in one of a period in which a liquid ejecting command is issued and part of the period, or in one of a period in which energy is supplied to the energy generating elements for ejection of liquid and part of the period.

22. A liquid ejecting device using a head including a liquid ejecting portion or a plurality of liquid ejecting portions arranged in parallel in a predetermined direction, said liquid ejecting portion or each of the liquid ejecting portions comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction, and at least one current-mirror circuit is connected to a junction of the energy generating elements; and by using said at least one current-mirror circuit to allow a current to flow into or to flow from the junction of the energy generating elements, the amount of a current supplied to each of the energy generating elements is controlled and the direction of the liquid ejected from said nozzle is controlled.

23. A liquid ejecting method using a line head formed by a plurality of heads arranged in a predetermined direction, the heads each being formed by a plurality of liquid ejecting portions arranged in parallel in said predetermined direction, the liquid ejecting portions each comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the energy generating elements are connected in series to one another and are arranged in parallel in said predetermined direction, and at least one current-mirror circuit is connected to a junction of the energy generating elements; and by using said at least one current-mirror circuit to allow a current to flow into or to flow from the junction of the energy generating elements, the amount of a current supplied to each of the energy generating elements is controlled and the direction of the liquid ejected from said nozzle is controlled.

24. A liquid ejecting device having a head including a plurality of liquid ejecting portions arranged in parallel in a predetermined direction, the liquid ejecting portions each comprising:

a liquid cell for containing liquid;

at least one energy generating element provided in said liquid cell which produces a bubble in response to the supply of energy; and a nozzle for ejecting the liquid in said liquid cell by using the bubble produced by said at least one energy generating element, wherein:

in said liquid cell, the heating elements are connected in series to one another and are arranged in parallel in said predetermined direction;

said liquid ejecting device comprises:

main operation-control means which, by supplying equal amounts of currents to all the heating elements, performs control so that the liquid is ejected from said nozzle; and sub operation-control means which supplies currents to all the heating elements in said liquid cell, and which, by setting a difference between the amount of the current flowing in at least one of the heating elements and the amount of the current flowing in another one of the heating elements, performs control based on the difference so that the ejected liquid is deflected in said predetermined direction with respect to a direction in which liquid is ejected by said main operation-control means;

the liquid ejecting portions arranged in parallel are divided into a plurality of blocks so that groups of the liquid ejecting portions respectively belong to the blocks; and said liquid ejecting device comprises:

a dedicated circuit provided for each of the liquid ejecting portions; and a common circuit provided for each of the blocks which is shared by the liquid ejecting portions belonging to the block, and which includes at least part of one of said main operation-control means and said sub operation-control means and ejects liquid from one of the liquid ejecting portions belonging to the block.

25. A liquid ejecting device according to claim 24, wherein:

one end of the connected heating elements in said liquid cell is connected to a power supply for supplying current to the connected heating elements, and the other end thereof is connected to a first switching element which performs switching for supplying current to the connected heating elements; and said dedicated circuit comprises:

a current-mirror circuit connected to at least one junction of the connected heating elements; and a plurality of second switching elements which performs control using said current-mirror circuit so that a current is allowed to flow into or to flow from the junction of the connected heating elements.

26. A liquid ejecting device according to claim 24, wherein:

one end of the connected heating elements in said liquid cell is connected to a power supply for supplying current to the connected heating elements, and the other end thereof is connected to a first switching element which performs switching for supplying current to the connected heating elements; and said dedicated circuit comprises:

a current-mirror circuit connected to at least one junction of the connected heating elements; and a second switching element formed by a pair of switching element portions in which, when one of the switching element portions has one as an input and the other switching element portions has zero as an input, a current is allowed to flow into a junction of the heating elements by using said current-mirror circuit, in which, when one of the switching element portions has zero as an input and the other switching element portions has one as an input, a current is allowed to flow out from the junction of the heating elements by using said current-mirror circuit, and in which, when both the switching element portions have zeroes as inputs, no current is allowed to flow into and to flow from the junction of the heating elements by using said current-mirror circuit.

27. A liquid ejecting device according to claim 24, wherein:

one end of the connected heating elements in said liquid cell is connected to a power supply for supplying current to the connected heating elements, and the other end thereof is connected to a first switching element which performs switching for supplying current to the connected heating elements;

said dedicated circuit comprises:

a current-mirror circuit connected to at least one junction of the connected heating elements; and a second switching element which performs control using said current-mirror circuit so that a current is allowed to flow into or to flow from the junction of the connected heating elements; and said common circuit comprises:

a current-supply element used as a current supply for said second switching element;

a first control terminal which performs analog control on the value of a current supplied from said current-supply element to said second switching element; and a second control terminal which performs switching for the supply of the current from said current-supply element to said second switching element.

28. A liquid ejecting device according to claim 24, wherein:

one end of the connected heating elements in said liquid cell is connected to a power supply for supplying current to the connected heating elements, and the other end thereof is connected to a first switching element which performs switching for supplying current to the connected heating elements;

said dedicated circuit comprises:

a current-mirror circuit connected to at least one junction of the connected heating elements; and a second switching element which performs control using said current-mirror circuit so that a current is allowed to flow into or to flow from the junction of the connected heating elements;

said common circuit comprises:

current-supply elements used as current supplies for said second switching element which are connected in parallel to one another;

a first control terminal which is connected in common to said current-supply elements and which performs analog control on the total value of currents supplied from said current-supply elements to said second switching element; and a second control terminal which is provided in each of said current-supply elements and which performs switching for supplying a current from each of said current-supply elements to said second switching element; and a constant ratio of currents in said current-supply elements is maintained by controlling a potential applied to said first control terminal, and the total value of currents supplied from said current-supply elements to said second switching element are controlled by independently inputting one or zero to said second control terminal for each of said current-supply elements.

29. A liquid ejecting device according to claim 24, wherein:

one end of the connected heating elements in said liquid cell is connected to a power supply for supplying current to the connected heating elements, and the other end thereof is connected to a first switching element which performs switching for supplying current to the connected heating elements;

said dedicated circuit comprises:

a current-mirror circuit connected to at least one junction of the connected heating elements; and a second switching element which performs control using said current-mirror circuit so that a current is allowed to flow into or to flow from the junction of the connected heating elements;

said common circuit comprises:

current-supply elements used as current supplies for said second switching element which are connected in parallel to one another;

a first control terminal which is connected in common to said current-supply elements and which performs analog control on the total value of currents supplied from said current-supply elements to said second switching element; and a second control terminal which is provided in each of said current-supply elements and which performs switching for supplying a current from each of said current-supply elements to said second switching element;

a constant ratio of currents in said current-supply elements is maintained by controlling a potential applied to said first control terminal, and the total value of currents supplied from said current-supply elements to said second switching element is controlled by independently inputting one or zero to said second control terminal for each of said current-supply elements;

each of said current-supply elements is formed by a unit element or by unit elements having identical characteristics which are connected in parallel to one another;

the connected current-supply elements are arranged in parallel so that the unit elements are in the ratio of powers of two; and when one or zero is independently input to the second control terminal in each of said current-supply elements, a current supplied from said current-supply elements to said second switching element is changed in units of powers of two so as to satisfy the expression:

$$I=(2^n\cdot D_n+2^{n-1}\cdot D_{n-1}+\ldots+2\cdot D_2+D_1)\cdot I_0$$

where $I_0$ represents a current supplied for a unit element, n represents the total number of second control terminals, $D_1, D_2, \ldots, D_n$ each represent one or zero as an input to one second control terminal.

30. A liquid ejecting device according to claim 24, wherein:

one end of the connected heating elements in said liquid cell is connected to a power supply for supplying current to the connected heating elements, and the other end thereof is connected to a first switching element which performs switching for supplying current to the connected heating elements;

said dedicated circuit comprises:

a current-mirror circuit connected to at least one of the connected heating elements; and a second switching element which performs control using said current-mirror circuit so that a current is allowed to flow into or to flow from a junction of the connected heating elements;

said common circuit comprises:

current-supply elements used as current supplies for said second switching element which are connected in parallel to one another;

a first control terminal which is connected in common to said current-supply elements and which performs analog control on the total value of currents supplied from said current-supply elements to said second switching element; and a second control terminal which is provided in each of said current-supply elements and which performs switching for supplying a current from each of said current-supply elements to said second switching element;

a constant ratio of currents in said current-supply elements is maintained by controlling a potential applied to said first control terminal, and the total value of currents supplied from said current-supply elements to said second switching element is controlled by independently inputting one or zero to said second control terminal for each of said current-supply elements;

in one current-supply element among the current-supply elements which has the least current supplied to said second switching element, by controlling the input of the second control terminal to be always one, the total value of the currents supplied to said second switching element is prevented from being zero; and when one or zero is independently input to each of second control terminals other than the second control terminal controlled to be always one, the total value of the currents from the current-supply elements to said second control terminal is changed into an even number of positive and negative values which are symmetrical with respect to zero, and the total value of the currents supplied from the current-supply elements to said second control terminal in response to the input value of said second control terminal is changed in arithmetic progression.

31. A liquid ejecting device according to claim 24, wherein:

one end of the connected heating elements in said liquid cell is connected to a power supply for supplying current to the connected heating elements, and the other end thereof is connected to a first switching element which performs switching for supplying current to the connected heating elements;

said dedicated circuit comprises:

a current-mirror circuit connected to at least one of the connected heating elements; and a second switching element which performs control using said current-mirror circuit so that a current is allowed to flow into or to flow from a junction of the connected heating elements;

said common circuit comprises:

current-supply elements used as current supplies for said second switching element which are connected in parallel to one another;

a first control terminal which is connected in common to said current-supply elements and which performs analog control on the total value of currents supplied from said current-supply elements to said second switching element; and a second control terminal which is provided in each of said current-supply elements and which performs switching for supplying a current from each of said current-supply elements to said second switching element; and in one current-supply element among the current-supply elements which has the least current supplied to said second switching element, by controlling the input of the second control terminal to be always one, the total value of the currents supplied to said second switching element is prevented from being zero; and when one or zero is independently input to each of second control terminals other than the second control terminal controlled to be always one, the value of the currents from the current-supply elements to said second control terminal is changed into an even number of positive and negative values which are symmetrical with respect to zero, and the total value of the currents supplied from the current-supply elements to said second control terminal in response to the input value of said second control terminal is changed in arithmetic progression; and said liquid ejecting device comprises a sign-change circuit in which, when one or zero is input the second control terminals in predetermined order, the order of currents output from the current-supply elements is changed.

* * * * *